US011889909B2

(12) United States Patent
Hori et al.

(10) Patent No.: US 11,889,909 B2
(45) Date of Patent: Feb. 6, 2024

(54) CONTAINER WITH ELASTIC SCREEN

(71) Applicant: YOSHIDA INDUSTRIES CO., LTD., Tokyo (JP)

(72) Inventors: Yumiko Hori, Tokyo (JP); Kyohei Nomoto, Tokyo (JP)

(73) Assignee: YOSHIDA INDUSTRIES CO., LTD., Tokyo (JP)

( * ) Notice: Subject to any disclaimer, the term of this patent is extended or adjusted under 35 U.S.C. 154(b) by 124 days.

(21) Appl. No.: 17/807,141

(22) Filed: Jun. 16, 2022

(65) Prior Publication Data

US 2022/0400832 A1 Dec. 22, 2022

(30) Foreign Application Priority Data

Jun. 18, 2021 (JP) ..... 2021-101954

(51) Int. Cl.
*A45D 33/02* (2006.01)
*A45D 33/24* (2006.01)

(52) U.S. Cl.
CPC ..... *A45D 33/025* (2013.01); *A45D 33/24* (2013.01)

(58) Field of Classification Search
CPC ..... A45D 33/025; A45D 33/24; A45D 33/006
USPC ..... 206/581, 823
See application file for complete search history.

(56) References Cited

U.S. PATENT DOCUMENTS

| | | | | |
|---|---|---|---|---|
| 9,867,447 | B1 * | 1/2018 | Kim | A45D 40/24 |
| 2015/0027487 | A1 * | 1/2015 | Apodaca | A45D 33/006 132/307 |
| 2016/0235184 | A1 * | 8/2016 | Lee | B65D 51/18 |
| 2020/0337435 | A1 * | 10/2020 | Hori | A45D 34/04 |
| 2020/0397120 | A1 * | 12/2020 | Jeong | A45D 34/00 |

FOREIGN PATENT DOCUMENTS

| | | | |
|---|---|---|---|
| JP | H07-043575 | U | 9/1995 |
| JP | H09-191930 | A | 7/1997 |
| JP | 2005-224398 | A | 8/2005 |
| JP | 2008-194190 | A | 8/2008 |
| JP | 2016-093213 | A | 5/2016 |

* cited by examiner

*Primary Examiner* — Jacob K Ackun
(74) *Attorney, Agent, or Firm* — Isshiki & Partners; Joseph P. Farrar, Esq.

(57) ABSTRACT

A container with elastic screen has a container body with an opening therein for extracting the contents; an outer lid that seals the opening, detachably attachable to the container body; a screen made of elastic mesh material, disposed so as to cover the opening; and a mesh adjustment mechanism for adjusting a mesh size of the screen. The mesh adjustment mechanism includes a moving member and a fixed member. With a normal direction to the plane in which the screen is stretched as the vertical direction, the moving member has a portion that contacts in a ring shape the peripheral edge of the top surface of the screen and makes the portion movable in the vertical direction with respect to the opening. The fixed member is fixed to the opening while fixing a vertical position of the moving member.

6 Claims, 16 Drawing Sheets

CONTAINER WITH ELASTIC SCREEN

CROSS-REFERENCE TO RELATED APPLICATION

This application claims priority pursuant to 35 U.S.C. § 119 from Japanese Patent Application No. 2021-101954, filed on Jun. 18, 2021, the entire contents of which are incorporated herein by reference.

BACKGROUND

Technical Field

The present disclosure relates to a container with elastic screen.

Related Art

There are cosmetic powder containers in which a screen is placed in the opening or mouth of the container body in which contents are stored. The container screens are made of an elastic mesh material. The screen is provided, for example, in an inner lid fitted into the container body, with the screen stretched over a frame and the inner lid fitted into the opening of the container body. The contents of the container body are then extracted through the screen. In some cases, the powder storage container is provided with a screen in which the density of the mesh differs depending on the particular location on the screen, so that the amount of contents extracted can be controlled In an ordinary container with screen, the density of the mesh is uniform over the entire surface when no external force is applied to the screen. Therefore, in order to control the amount of contents extracted, the force for pressing the contents located below the screen from the top of the screen must be adjusted.

In contrast, in the powder storage container provided with a screen in which the density of the mesh changes continuously from coarse to fine, changing the position on the surface of the screen where the contents are extracted enables the amount of contents extracted to be controlled.

However, in such a container, to control the amount of contents extracted it is necessary to extract the contents from a limited area out of the entire area of the screen where the mesh has an appropriate density. As a result, it is naturally difficult to extract quickly a sufficient amount of contents. In addition, it is also difficult to prevent the contents from leaking from other areas of the screen. Moreover, with such a powder storage container, the smaller the area of the opening of the container in which the screen is stretched the more pronounced the above-described problem becomes.

SUMMARY

Therefore, an object of the present disclosure is to provide a container with elastic screen that enables the amount of contents extracted to be easily controlled.

To achieve the above-described object, one aspect of the present disclosure provides a container with elastic screen including a container body for storing contents, having an opening therein to extract the contents; an outer lid that seals the opening, detachably attachable to the container body; a screen made of elastic mesh material, disposed so as to cover the opening of the container body; and a mesh adjustment mechanism for adjusting a mesh size of the screen, having a moving member and a fixed member. With a normal direction to the plane in which the screen is stretched as the vertical direction, the moving member has a portion that contacts in a ring shape the peripheral edge of the top surface of the screen and makes the portion movable in the vertical direction with respect to the opening and the fixed member fixes a vertical position of the moving member while being fixed to the opening.

The container with elastic screen may further include a screen pressing member composed of a hollow cylindrical outer tube and a hollow cylindrical inner tube coaxially disposed and connected by an annular top surface provided at a top end of the outer tube and the inner tube. The container body has a top end in which the opening is formed and a hollow cylindrical neck with a male screw thread formed on the outer peripheral surface thereof, the mesh adjustment mechanism is constructed of the neck as the fixed member and the screen pressing member as the moving member, and the outer tube of the screen pressing member has a female screw thread formed on the inner peripheral surface thereof that engages the male screw thread formed on the outer peripheral surface of the neck. When the outer tube is screwed into the neck, a bottom edge of the inner tube contacts the peripheral edge of the top surface of the screen and presses the peripheral edge downward, and the mesh size of the screen is adjusted according to how far the outer tube is screwed into the neck: The farther the outer tube is screwed into the neck, the more the screen is stretched outward from its periphery and the larger (sparser) the mesh becomes.

The mesh adjustment mechanism may further have as the fixed member a vertical positioning member having a flattened hollow cylindrical shape and which is fixed relative to the screen, and as the moving member has the screen pressing member, which is slidably fitted inside the fixed member. The screen pressing member may have projections protruding radially outward on an outer peripheral surface thereof, the vertical positioning member has grooves having a predetermined shape on the inner peripheral surface that engage the projections at a plurality of locations, the grooves have closed ends in the circumferential direction at a plurality of locations having different vertical positions, and the mesh size of the screen is adjusted by holding the projections of the screen pressing member at any one of the positions of the ends of the grooves formed at a plurality of locations.

The mesh adjustment mechanism may further have as the fixed member a vertical positioning member having a flattened hollow cylindrical shape and which is fixed relative to the screen, and as the moving member has the screen pressing member, which is slidably fitted inside the fixed member. The vertical positioning member may have grooves having a predetermined shape at a plurality of positions on the outer peripheral surface thereof and projections protruding radially inward from an inner peripheral surface thereof, the screen pressing member has grooves having a predetermined shape that engage the projections at a plurality of locations on the outer peripheral surface thereof, the grooves have closed ends in the circumferential direction at a plurality of locations having different vertical positions, and the mesh size of the screen is adjusted by holding the projections of the vertical positioning member at any one of the positions of the ends of the grooves formed at a plurality of locations.

The container with elastic screen may further include a mark indicating the mesh size of the screen in relation to the relative vertical position of the moving member with respect to the fixed member. The frame may be provided with an inner lid attached to the opening of the container body, with the screen stretched over the inner lid.

Effects of the Disclosure

According to the present disclosure, there is provided a container with elastic screen that enables the amount of contents extracted to be easily controlled. Other effects will be readily apparent from the following description.

DETAILED DESCRIPTION

Figure 1:
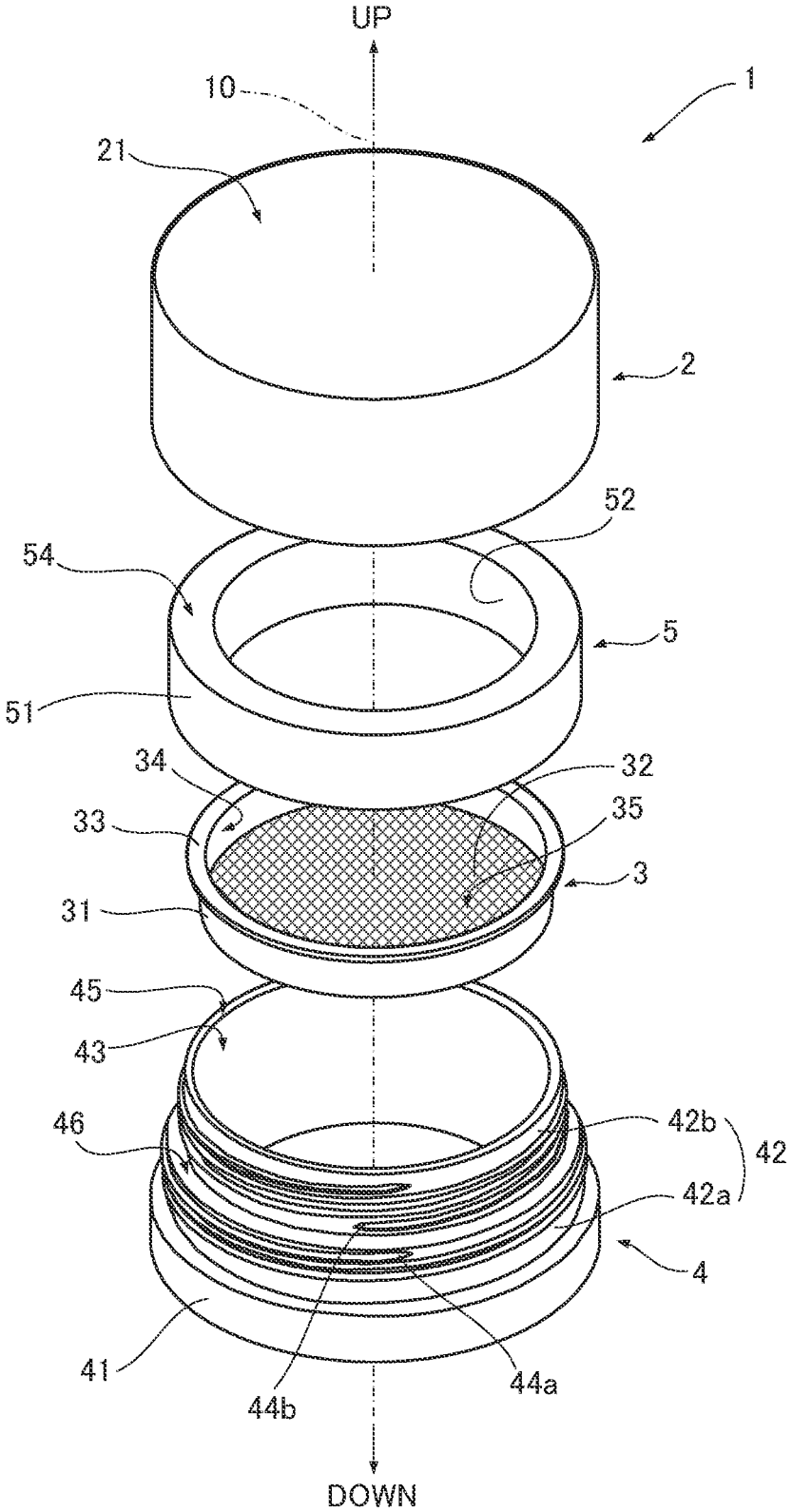
FIG. 1 is an exploded perspective view of a container with screen according to a first embodiment of the present disclosure as viewed from above.

Embodiments of the present disclosure are described below with reference to the accompanying drawing, in which the same or similar parts may be designated by the same reference numerals and duplicate description omitted.

Embodiments

Similar to a conventional container with screen, the container according to embodiments of the present disclosure comprises a container body for storing contents. The container body has an opening for extracting the contents and a screen that is disposed so as to cover the opening of the container body. Further, the container according to the embodiments includes an adjustment mechanism for adjusting the size of the mesh, that is, the fineness of the mesh (hereinafter referred to as mesh size) over the entire surface of the screen. As a result, the user of the container can easily control the amount of the contents extracted through the mesh of the screen. Further, since the container according to the embodiment can adjust the mesh size over the entire surface of the stretched screen, the amount of contents extracted can also be easily controlled even if the opening of the container body has a small area.

The mesh adjustment mechanism of the container according to the embodiments utilizes the fact that when a screen made of an elastic mesh material is stretched the mesh size becomes sparser (i.e., increases) than it is in the unstretched state. If the normal direction to the plane in which the screen is stretched is the vertical direction (defined as the container body opening upward), then the mesh adjustment mechanism is configured to include a moving member that can move in the vertical direction while contacting the peripheral edge of the screen and a fixed member that fixes the mesh size of the screen in an adjusted state by fixing the vertical position of the moving member. As the container according to first and second embodiments a description is given below of a screen-equipped container for storing cosmetic made of powder, in which the moving member and the fixed member that together constitute the mesh adjustment mechanism have different configurations.

First Embodiment

Basic Configuration

Figure 2:
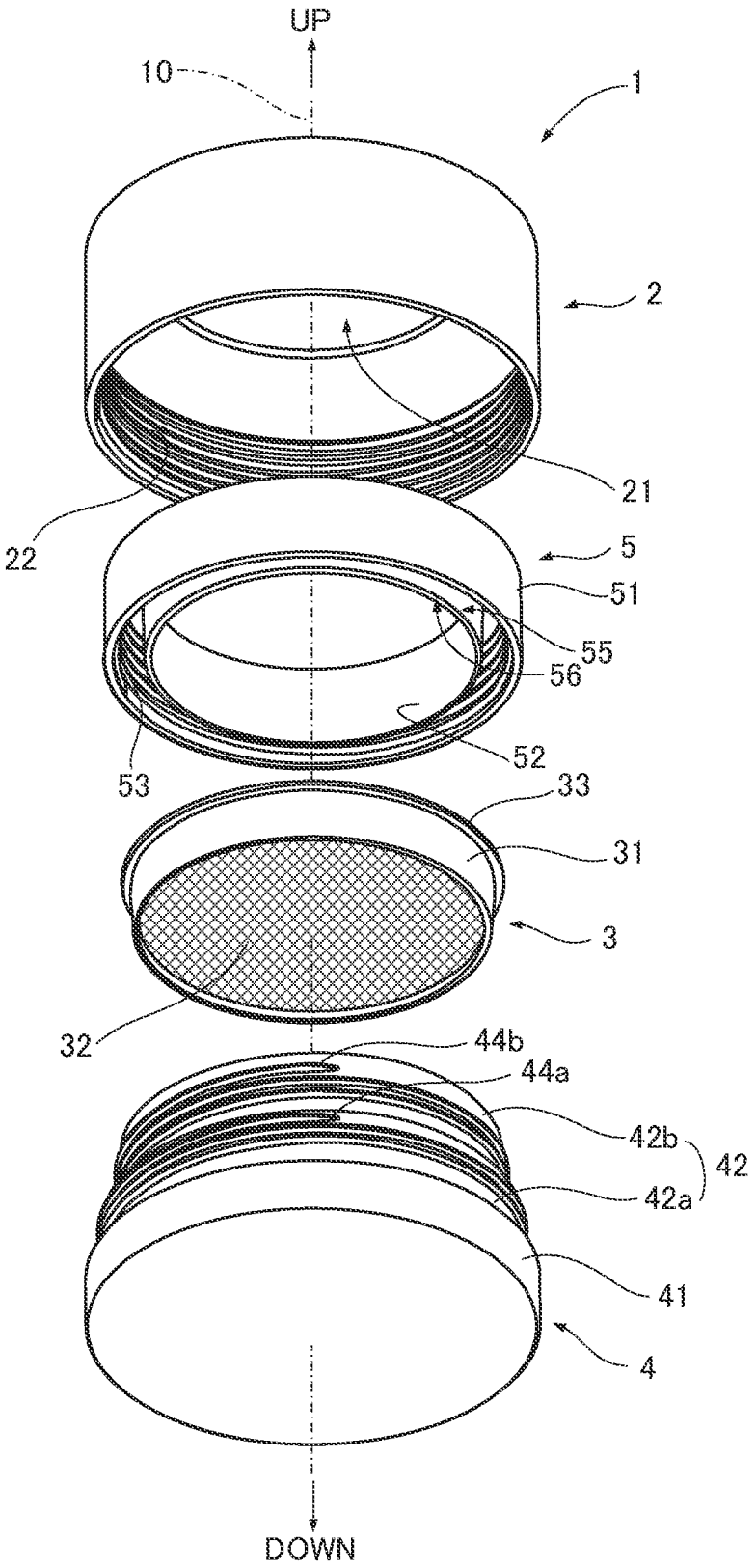
FIG. 2 is an exploded perspective view of a container with screen according to the first embodiment as viewed from below.

FIGS. 1 and 2 illustrate the configuration of a container 1 according to a first embodiment, in which FIG. 1 is an exploded perspective view of the container 1 as viewed from above and FIG. 2 is an exploded perspective view of the container 1 as viewed from below. As illustrated in FIGS. 1 and 2, as a basic configuration the container 1 has a container body 4 for storing cosmetic in powder form, an outer lid 2 that is detachably attachable to the container body 4 and which seals an opening 43 of the container body 4, and an inner lid 3 that is attached to the opening 43 of the container body 4. The container 1 further includes a screen pressing member 5 that constitutes the moving member of a mesh adjustment mechanism (to be described in detail later). In the following description, it is assumed that the outer lid 2, the inner lid 3, the container body 4 and the pressing member 5 constituting the container 1 are assembled in a state of being arranged coaxially along a common cylindrical longitudinal axis 10 (hereinafter referred to simply as axis 10). Further, regarding the upper part and the lower part of each of the outer lid 2, the inner lid 3, the container body 4 and the pressing member 5, the upper and lower directions in the assembled state are used as directional references regardless of actual up and down.

The container body 4 is an integrally molded product made of plastic, and in shape has a hollow cylindrical neck 42 of reduced diameter with respect to a flat bottomed cylindrical portion 41 (hereinafter referred to as base 41), with the neck 42 situated atop and continuous with the base 41. The neck 42 has a circular opening at the top end, and this opening 43 serves as an outlet for the contents. With the axis 10 set in the vertical direction passing through the center of the opening 43, the neck 42 is a two-stage cylinder formed by connecting two hollow cylinders of different diameters along the same axis 10 in the vertical direction. The upper part of the neck 42*b* (hereinafter referred to as upper neck 42*b*) is reduced in diameter with respect to the lower part of the neck 42*a* (hereinafter referred to as lower neck 42*a*). Male screw threads 44*a*, 44*b* are formed on the outer peripheries of both the upper neck 42*b* and the lower neck 42*a*.

Figure 3:
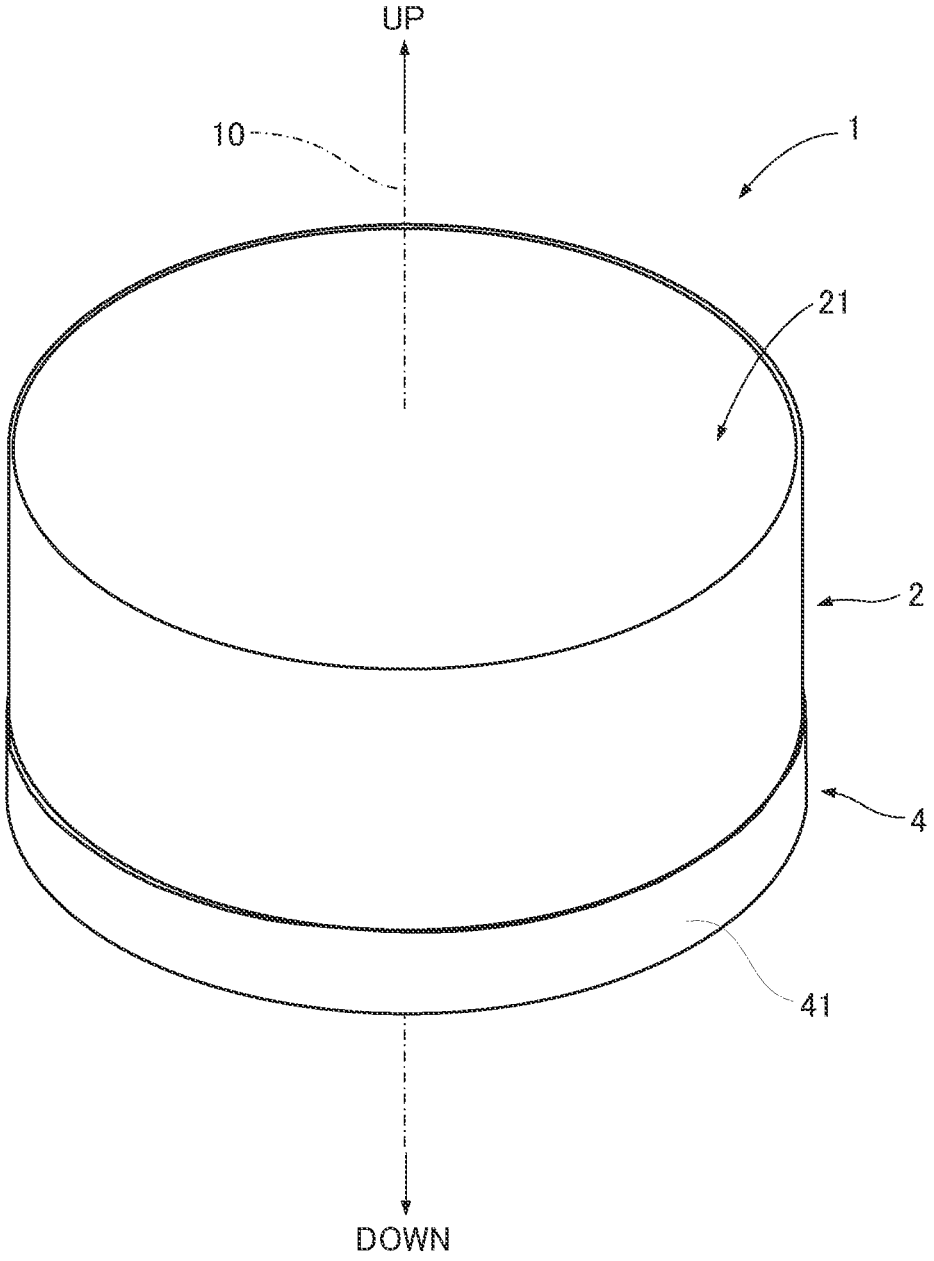
FIG. 3 is a diagram illustrating the external appearance of a container with screen according to the first embodiment.

The outer lid 2 is an integrally molded product made of plastic and has a hollow cylindrical shape having a closed top 21. As illustrated in FIG. 2, a female screw thread 22 that screws onto the male screw thread 44*a* of the lower neck 42*a* in the container body 4 is formed on the inner peripheral surface of the outer lid 2, to form a so-called screw cap. The outer lid 2 is attached to the container body 4 by being screwed into the lower neck 42*a*. FIG. 3 illustrates container 1 with the outer lid 2 attached to the container main body 4.

As illustrated in FIGS. 1 and 2, the inner lid 3 has a flattened hollow cylindrical shape and is configured by a cylindrical frame 31 made of integrally molded plastic and a brim-shaped flange 33 continuous with and formed around the top of the frame 31. A screen 32 made of an elastic mesh material is stretched around the bottom of the frame 3. When the frame 31 of the inner lid 3 is fitted into the opening 43 of the container body 4, the bottom of the flange 33 contacts the top 45 of the peripheral edge of the opening 43 of the container body 4 to support the inner lid 3 and prevent it from falling into the container body 4. As a result, the opening 43 of the container body 4 is covered with the stretched screen, such that the contents of the container body 4 are extracted through the mesh of the screen 32.

Mesh Adjustment Mechanism

In addition to the above-described basic configuration, the container 1 has a mesh adjustment mechanism for variably adjusting the mesh size of the screen 32 in the inner lid 3 over the entire inner surface of the frame 31. The mesh adjustment mechanism in the container 1 according to the first embodiment is composed of the upper neck 42*b*, which is a fixed member, and the screen pressing member 5, which is a moving member.

The screen pressing member 5 is an integrally molded product made of plastic, and as illustrated in FIG. 2 has a double cylindrical shape in which a hollow cylindrical outer tube 51 and a hollow cylindrical inner tube 52 are formed coaxially on the same axis 10. The top end of the screen pressing member 5 is an annular top 54 that connects the outer tube 51 and the inner tube 52. The inner tube 52 has an inner diameter that matches the inner diameter of the annular top 54 and extends downward to open at the bottom end. Further, a female screw thread 53 that screws onto the male screw thread 44*b* of the upper neck 42*b* is formed in the inner peripheral surface of the outer cylinder 51.

Figure 4:
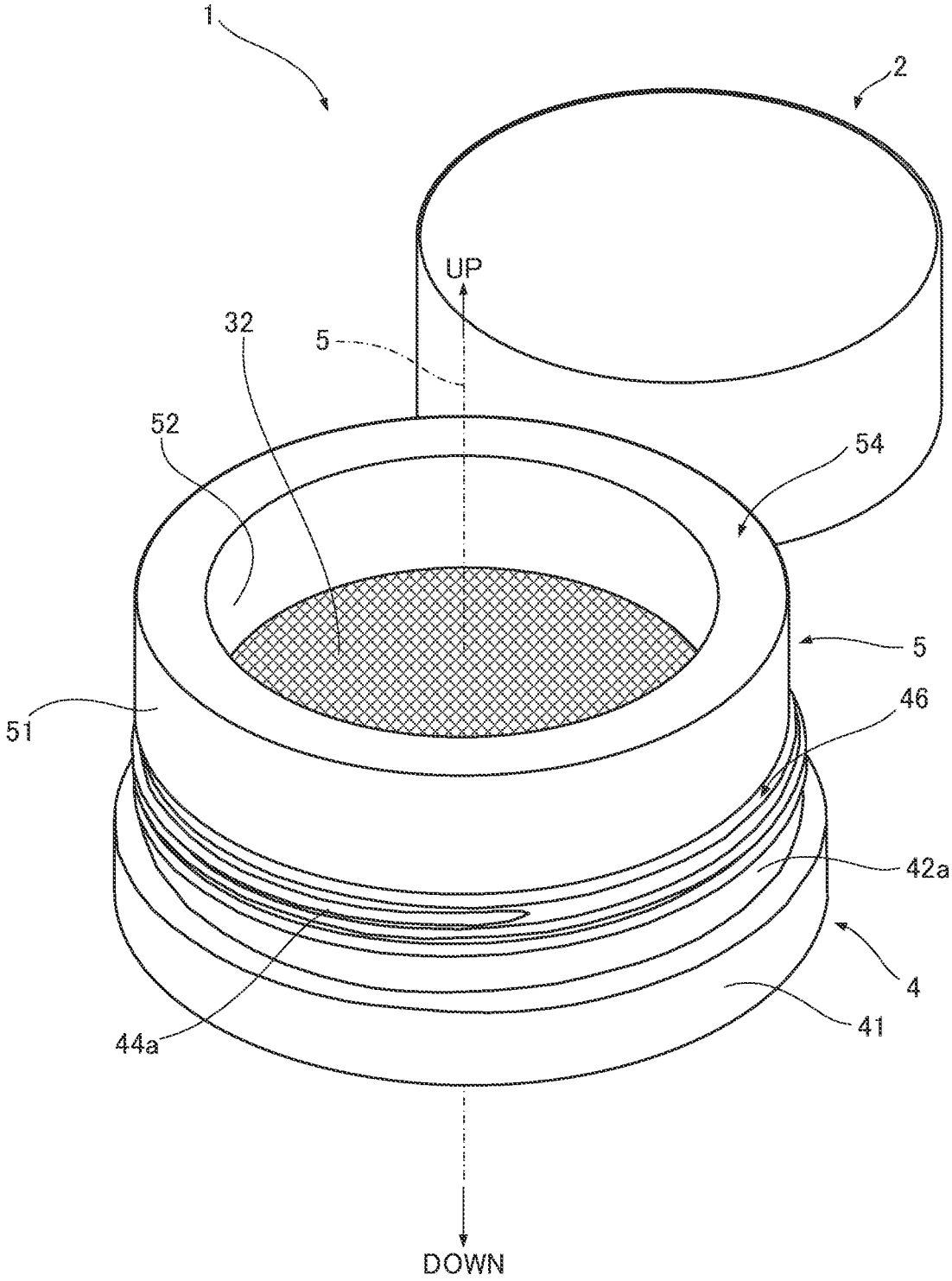
FIG. 4 is a diagram illustrating the external appearance of a container with screen according to the first embodiment with an outer lid removed.

The outer diameter of the inner tube 52 of the screen pressing member 5 is slightly smaller than the inner diameter of the frame 31 constituting the inner lid 3. As a result, when the screen pressing member 5 is attached to the upper neck 42*b*, the outer peripheral surface of the inner tube 52 (reference numeral 55 in FIG. 2) slidably contacts the inner peripheral surface of the frame 31 in the inner lid 3 (reference numeral 34 in FIG. 1). Moreover, when the screen pressing member 5 is attached to the upper neck 42*b* of the container body 4, the screen pressing member 5 can be screwed in until the bottom surface of the top 54 contacts the top surface of the flange 33 of the inner lid 3. The container 1 is designed so that, when closed, the bottom surface of the top 21 of the outer lid 2 contacts the top 54 of the pressing member 5 so that the outer lid 2 and the lower neck 42*a* screwed into the outer lid 2 are sealed tightly together when the screen pressing member 5 is attached to the upper neck 42*b* regardless of the relative vertical position of the screen pressing member 5 with respect to the inner lid 3. For reference, FIG. 4 illustrates the container 1 with the outer lid 2 removed.

Figure 5A:
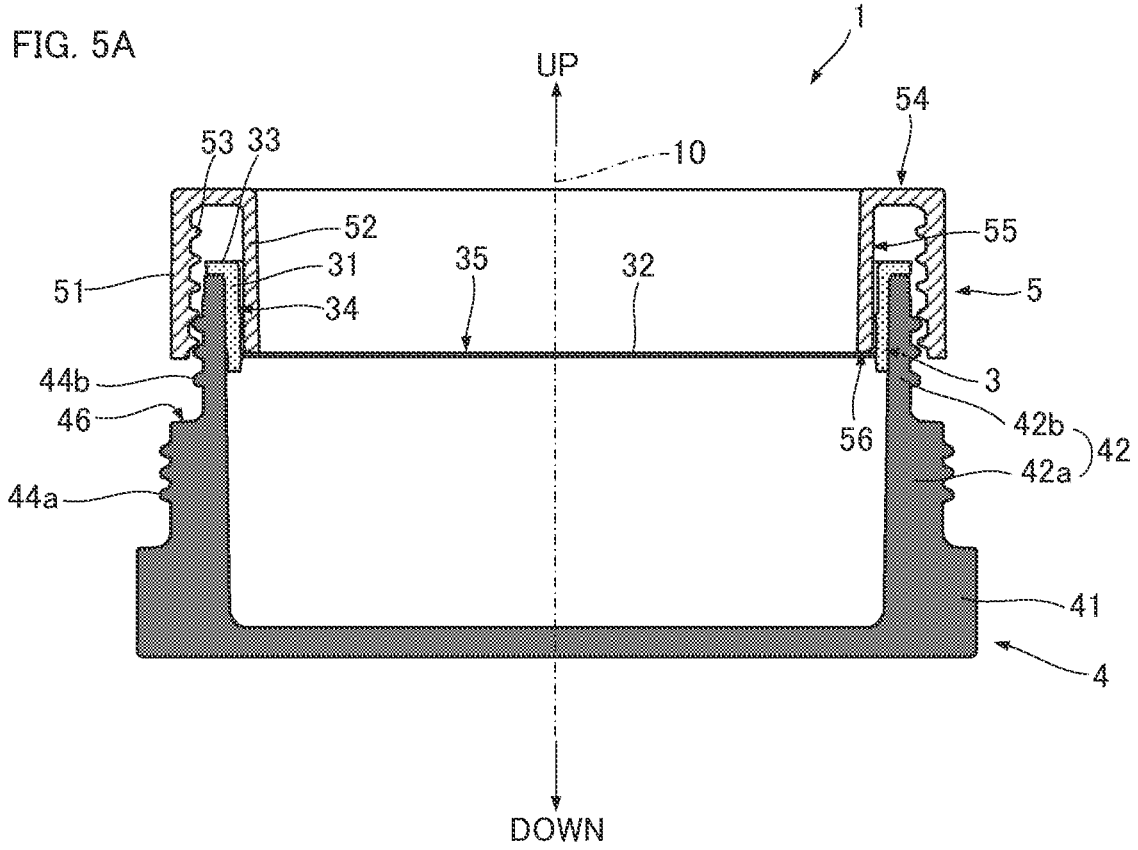
FIGS. 5A and 5B are diagrams for explaining the operation of a mesh adjustment mechanism provided in the container with screen according to the first embodiment.
Figure 5B:
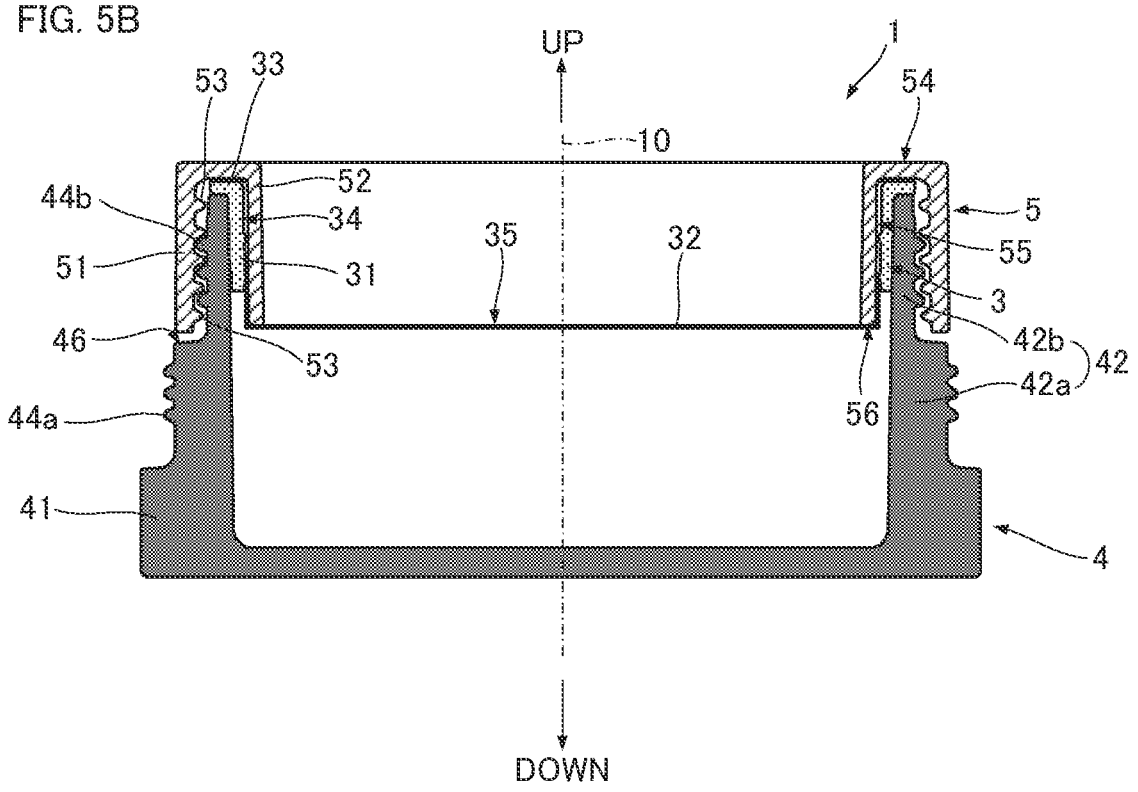

The operation of the mesh adjustment mechanism is now described with reference to FIGS. 5A and 5B. FIGS. 5A and 5B illustrate vertical cross-sections of the container 1 along the plane of the axis 10, in which the outer lid 2 is omitted for clarity and convenience.

As illustrated in FIG. 5A, when the screen pressing member 5 is screwed into the upper neck 42*b* the bottom edge 56 of the inner tube 52 contacts the peripheral edge of the top surface 35 of the screen 32. As illustrated in FIG. 5B, when the screen pressing member 5 is further screwed in, the peripheral edge portion of the screen 32 is pressed downward by the bottom edge 56 of the inner tube 52, thereby expanding the mesh of the elastic screen 32. As described above, the container 1 according to the first embodiment can steplessly variably adjust the mesh size of the screen 32 according to how far the screen pressing member 5 is screwed into the upper neck 42*b*: The farther the screen pressing member (outer tube) 5 is screwed into the upper neck 42*b*, the more the screen 32 is stretched outward from its periphery and the larger (sparser) the mesh becomes. With the container 1 according to the first embodiment, the outer lid 2 can be attached to the container body 4 regardless of whether the screen 32 is unstretched and the mesh size is in an initial state unadjusted by the mesh adjustment mechanism or the screen 32 is stretched and the mesh size is adjusted. As a result, it is not necessary to adjust the mesh size every time the contents are extracted from the container 1. Of course, the mesh adjustment mechanism can be adjusted at each opportunity to retrieve the contents according to the user's preference.

Second Embodiment

Basic Configuration

Figure 6:
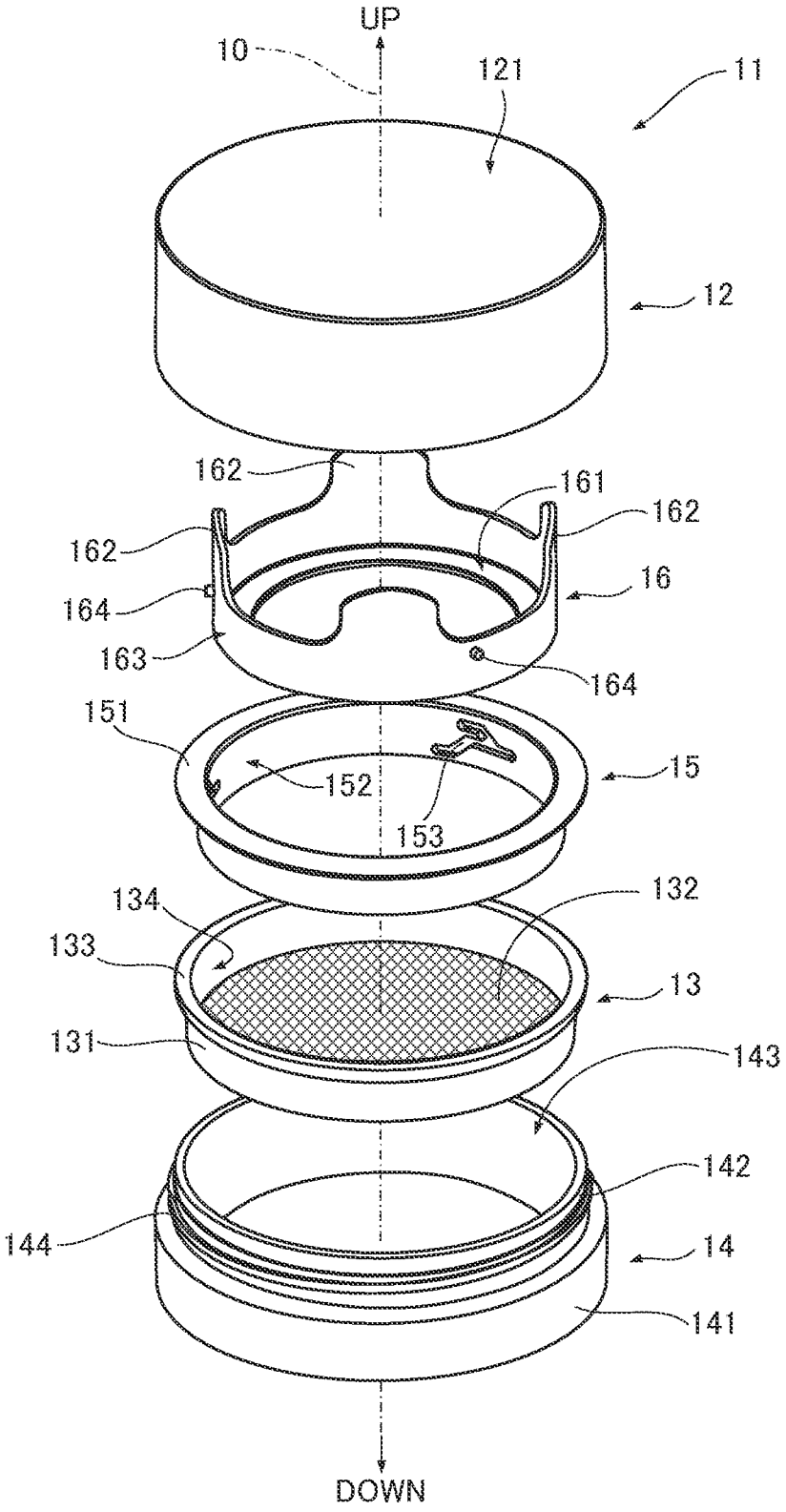
FIG. 6 is an exploded perspective view of a container with screen according to a second embodiment of the present disclosure as viewed from above.
Figure 7:
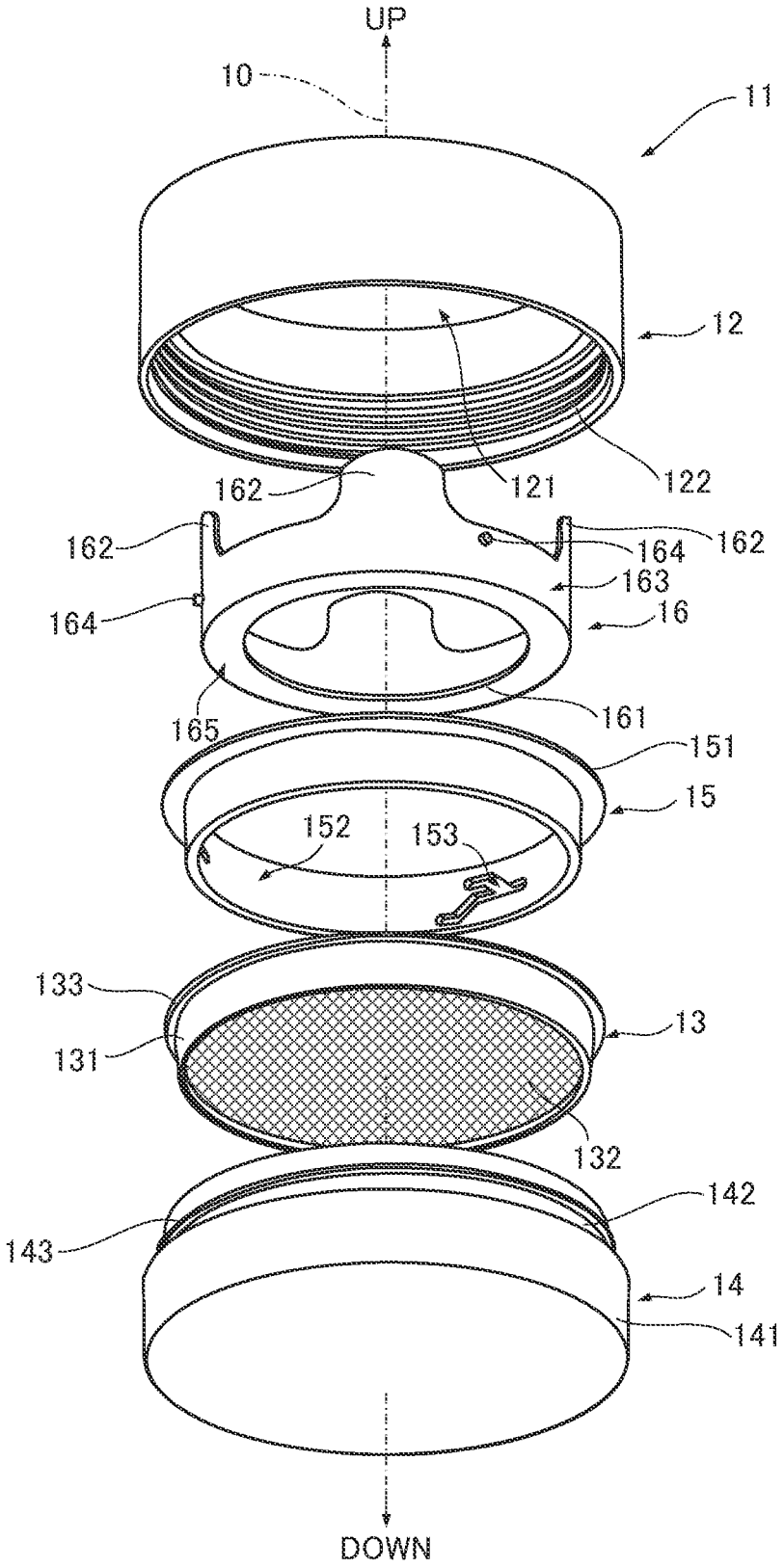
FIG. 7 is an exploded perspective view of a container with screen according to the second embodiment as viewed from below.

Next, a description is given of a second embodiment of a container having a mesh adjustment mechanism configuration different from that of the first embodiment. FIG. 6 and FIG. 7 are respective perspective views of a container 11 according to the second embodiment in a disassembled state, showing each component thereof. FIG. 6 is an exploded perspective view of the container 11 as viewed from above, and FIG. 7 is an exploded perspective view of the container 11 as viewed from below. In the second embodiment as well, the axis 10 and the upper and lower directions are defined in the same manner as in the first embodiment.

As illustrated in FIGS. 6 and 7, the container 11 has a basic configuration including an outer lid 12, an inner lid 13 in which a screen 132 is stretched over a frame 131, and a container body 14. The container body 14 has a structure in which a neck 142 corresponding to the lower neck 42*a* of the container body 4 of the first embodiment is situated atop and continuous with a flattened bottomed cylindrical base 141 and a male screw thread 144 is formed on the outer peripheral surface of the neck 142. Similar to the outer lid 2 of the container 1 according to the first embodiment, the outer lid 12 has a cylindrical shape having a closed top surface 121 and opens downward, with a female screw thread 122 that screws onto the male screw thread 144 of the neck 142 formed on the inner peripheral surface of the outer lid 12.

Figure 8:
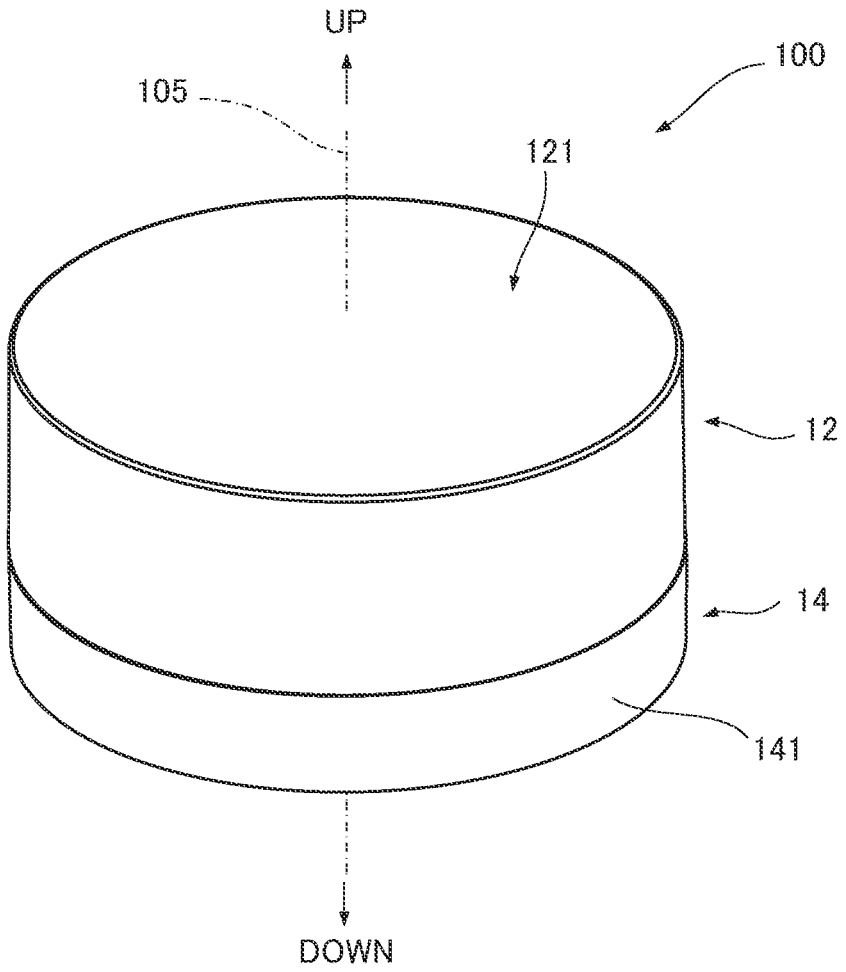
FIG. 8 is a diagram illustrating the external appearance of a container with screen according to the second embodiment.

Similar to the inner lid 3 of the container 1 according to the first embodiment, the inner lid 13 of the second embodiment has a screen 132 made of an elastic mesh material stretched over the bottom of the frame 131, with a flange 133 continuous with and formed around the top of the frame 131. The inner lid 13 is fitted into the neck 142 from an opening 143 of the container body 14 while the flange 133 is supported by the top edge of the neck 142. The outer lid 12, the frame 131, and the container body 14 are integrally molded plastic products like the container 1 according to the first embodiment. For reference, FIG. 8 illustrates a container 11 with the outer lid 12 attached to the container body 14. As illustrated in FIG. 8, the appearance of the container 11 in a state in which the outer lid 12 is attached is the same as that of the container 1 according to the first embodiment illustrated in FIG. 3.

Mesh Adjustment Mechanism

In addition to the basic configuration described above, the container 11 according to the second embodiment has a frame-shaped member 15 (hereinafter referred to as vertical positioning member 15) fixed inside the frame 131 of the inner lid 13 as a fixed member of the mesh adjustment mechanism and a screen pressing member 16 as a moving member of the mesh adjustment mechanism. Both the vertical positioning member 15 and the screen pressing member 16 are integrally molded products made of plastic.

The vertical positioning member 15 has a flattened hollow cylindrical shape with a flange 151 formed around the top end. The vertical positioning member 15 is fitted inside the inner lid 13 with the flange 151 supported by the top of the flange 133 of the inner lid 13. Grooves 153 branching in three formed in an inner peripheral surface 152 of the vertical positioning member 15 at three equal angular intervals around the axis 10. The grooves 153 all have the same shape and are located at the same vertical position in each of the three positions where they are formed.

The screen pressing member 16 is a hollow cylinder having a circular frame-shaped bottom 161 and continuous irregularities at equal angular intervals around the top along the circumferential direction. In the screen pressing member 16 of the container 11 according to the second embodiment as illustrated in the drawings, tongue-shaped portions 162 (hereinafter referred to as rotation assist members 162) that project convexly upward in curves from the sides of the screen pressing member 16 are formed at four points around the top of the screen pressing member 16. As will be described later, these rotation assist members 162 assist the user in easily applying a force in the rotation direction by, for example, hooking the fingers therearound when rotating the screen pressing member 16 around the axis 10. Further, projections 164 projecting radially outward with respect to the axis 10 are formed at three positions on the outer peripheral surface 163 of the screen pressing member 16 at equal angular intervals.

Figure 9:
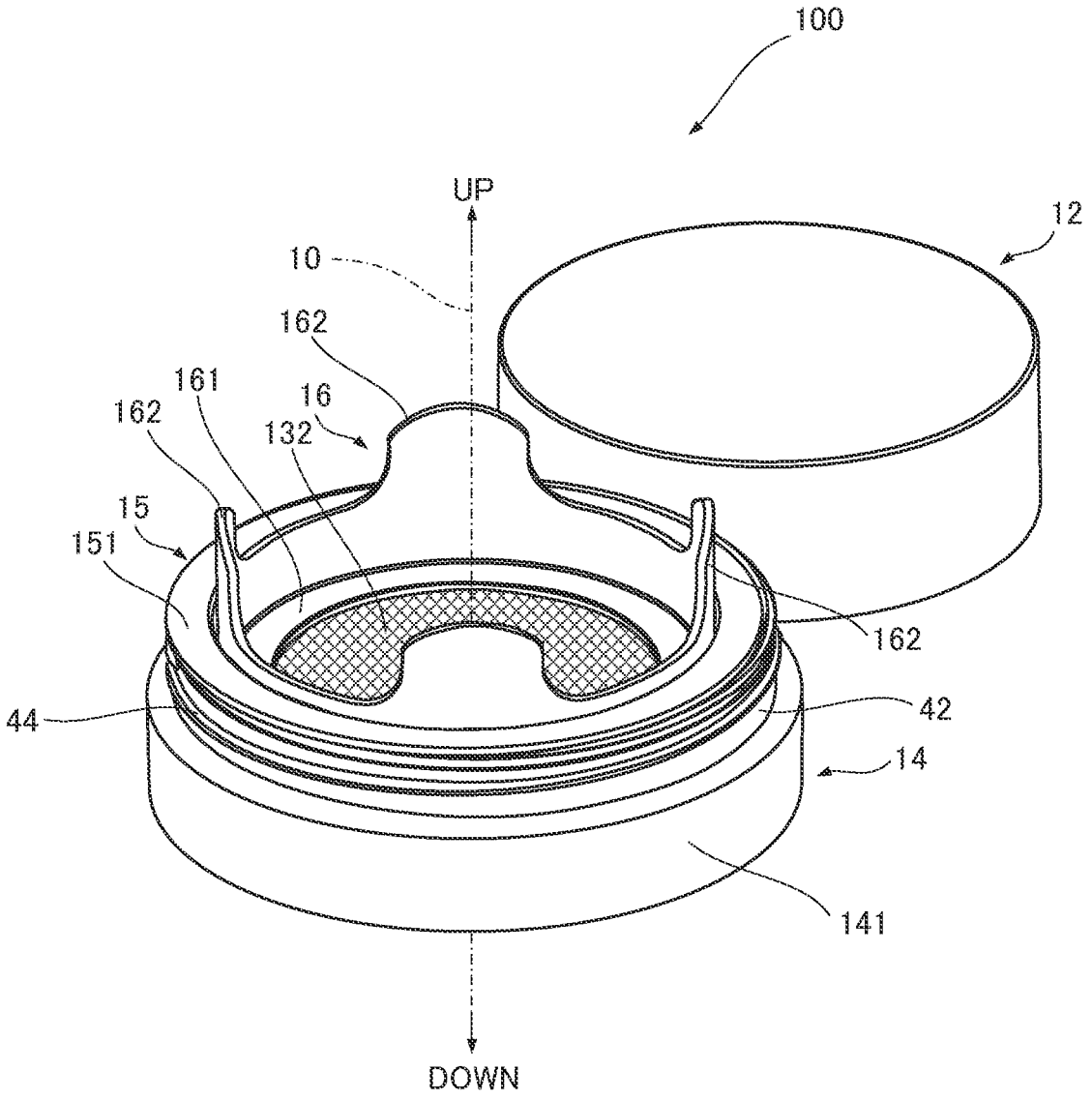
FIG. 9 is a diagram illustrating the external appearance of a container with screen according to the second embodiment with the outer lid removed.

FIG. 9 illustrates the appearance of the container 1 with the outer lid 12 removed. As illustrated in FIG. 9, the top surface 135 of the screen 132 is exposed upward through an opening in the bottom 161 of the screen pressing member 16. The rotation assist members 162 project upward from the top edge of the vertical positioning member 15. In the assembled container 11, the projections 164 of the screen pressing member 16 are fitted into the grooves 153 so that the screen pressing member 16 is loosely fitted inside the vertical positioning member 15. As a result, the screen pressing member 16 slides vertically and radially about the axis 10 relative to the vertical positioning member 15 within a range in which the projections 164 are guided by the grooves 153. Further, due to the shape of the inner walls at the ends of the grooves 153, the screen pressing member 16 is fixed in its vertical position when the projections 164 reach the ends of the grooves 153. Since the screen pressing member 16 is fitted inside the vertical positioning member 15 when the container 11 is assembled, it retains enough flexibility to absorb at least the height of the projections 164. Alternatively, if the screen pressing member 16 is not configured to be flexible, a path may be provided in the grooves 153 of the vertical positioning member 15 so as to extend upward or downward and open at the top end so that the projections 164 may be guided into the grooves 153 from the upwardly open end of the vertical positioning member 15.

Figure 10:
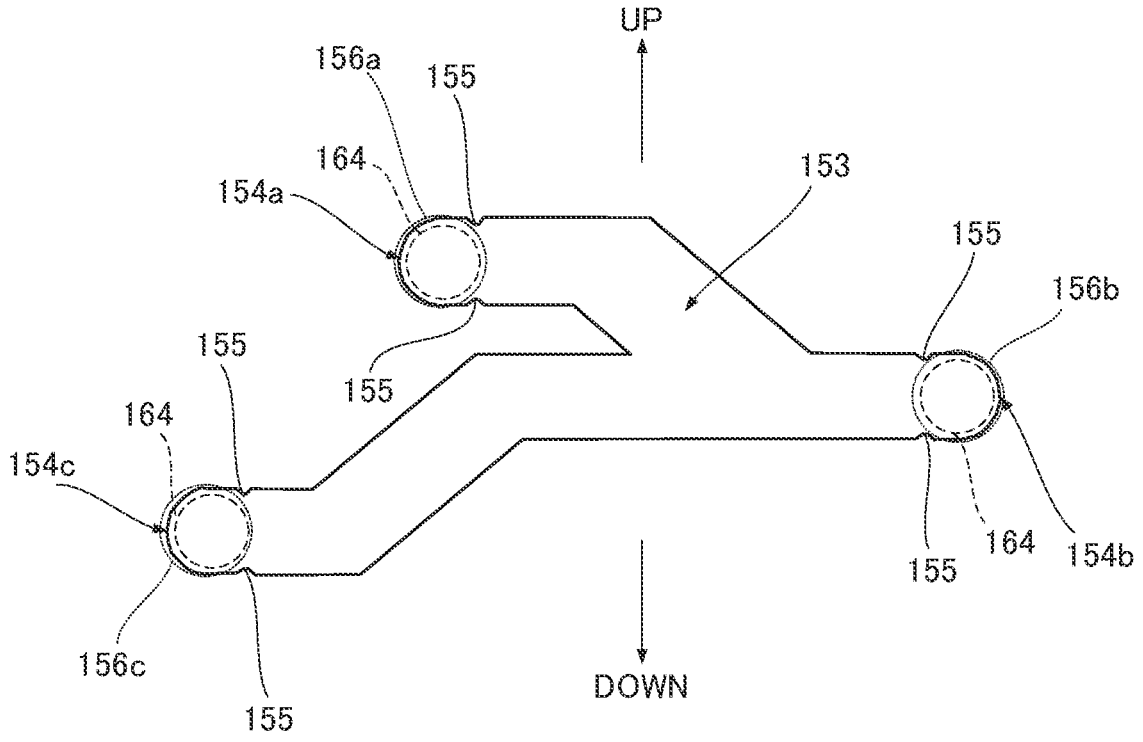
FIG. 10 is a diagram illustrating the shape of grooves formed in a vertical positioning member provided in a container with screen according to the second embodiment.

FIG. 10 illustrates in detail the shape of the grooves 153 formed in the vertical positioning member 15. As illustrated in FIG. 10, each of the grooves 153 branches in three directions while extending along the inner periphery of the vertical positioning member 15 (i.e., laterally along the surface of the paper on which the figure is drawn), with the ends of the branches 154*a*, 154*b*, 154*c* forming closed dead ends. When the projections 164 indicated by the broken line circles in FIG. 10 are fixed at any of the positions 154*a*, 154*b*, 154*c*, the screen pressing member 16 is also fixed at one of the three vertical positions with respect to the vertical positioning member 15.

In the grooves 153 illustrated in FIG. 10, inwardly convex portions 155 (hereinafter referred to as projecting portions 155) are formed on the inner wall on the ends (154*a*, 154*b*, 154*c*). When the projections 164 of the screen pressing member 16 move past the projecting portions 155 in the process of being guided by the grooves 153 to reach the ends 154*a*, 154*b*, 154*c*, the projections 164 are fixed in regions (upper region 156*a*, middle region 156*b*, lower region 156*c*) on the side of the ends 154*a*, 154*b*, 154*c* illustrated by the broken line circle in the figure. As a result, the projections 164 are prevented from inadvertently deviating from the regions 156*a*, 156*b*, 156*c* and the screen pressing member 16 is thus fixed at one of the three vertical positions.

Figure 11A:
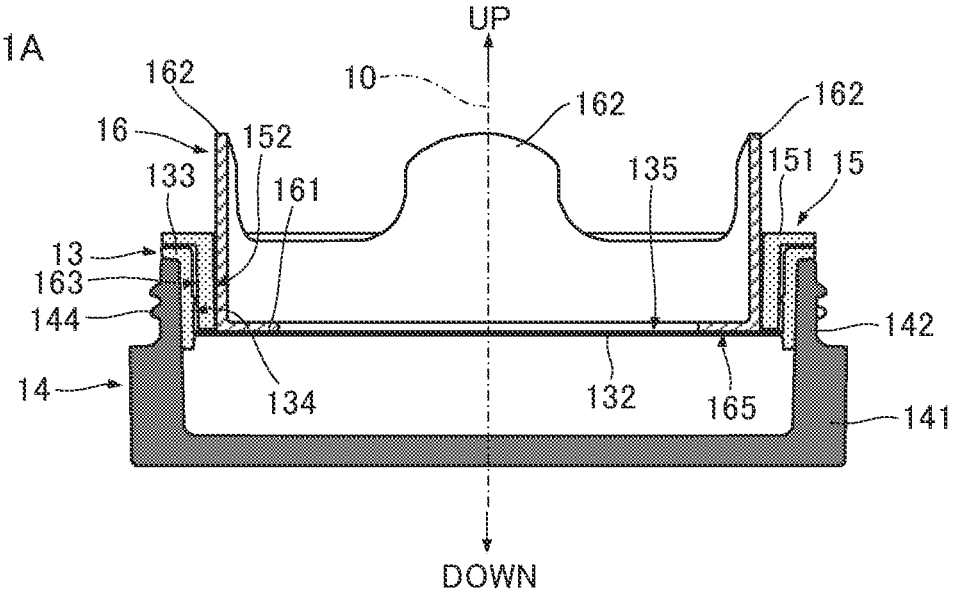
FIGS. 11A, 11B and 11C are diagrams for explaining the operation of the mesh adjustment mechanism provided in the container with screen according to the second embodiment.
Figure 11B:
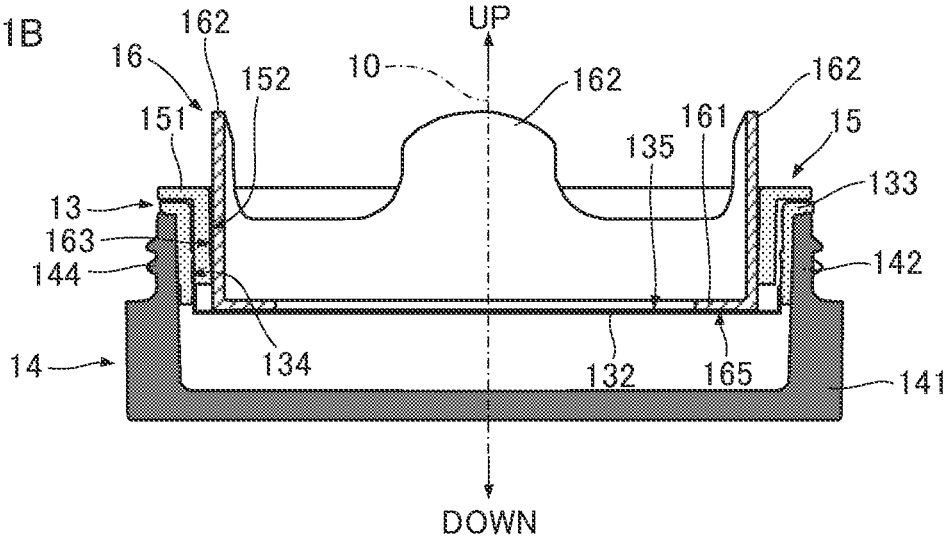
Figure 11C:
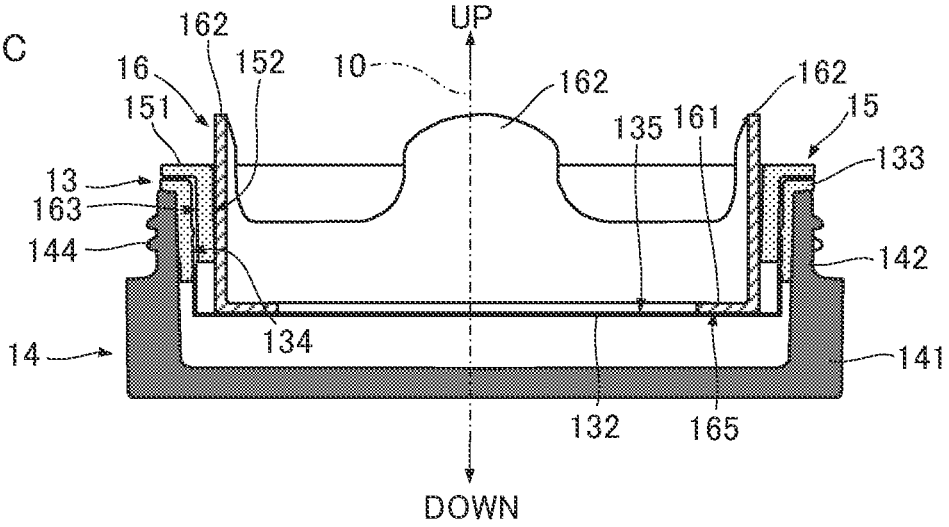

A description is now given of the mesh adjustment mechanism of the container 11 according to the second embodiment. FIGS. 11A, 11B, 11C illustrate the operation of the mesh adjustment mechanism of the container 11. That is, FIGS. 11A to 11C illustrate the state of the screen 132 when the projections 164 of the screen pressing member 16 are at each of the three positions 156*a*, 156*b*, 156*c* of the grooves 153 formed in the vertical positioning member 15.

As illustrated in FIG. 11A, when the projections 164 are at the upper position 156*a* in the grooves 153 the screen 132 maintains its original state of being stretched over the inner lid 13 even though the bottom surface of the bottom 161 of the screen pressing member 16 is in contact with the peripheral edge of the top surface 135 of the screen 132. Then, the user presses the screen pressing member 16 downward by putting the fingers on the rotation assist members 162 on the sides of the screen pressing member 16 while rotating the screen pressing member 16 with respect to the vertical positioning member 15. As a result, as illustrated in FIGS. 11B and 11C, once the projections 164 of the screen pressing member 16 are fixed in place at the middle position 156*b* of the grooves 153 and the lower position 156*c* of the grooves 153, respectively, the peripheral edge of the top surface 135 of the screen 132 is pressed downward by the bottom 161 of the screen pressing member 16 and the mesh size of the screen 132 in the initial stretched state is adjusted.

In this way, in the container 11 according to the second embodiment, the fixed position in the vertical direction of the screen pressing member 16 is set stepwise and the mesh size is set stepwise also, so that the previous mesh size can be reliably reproduced even after the vertical position of the screen pressing member 16 is changed. As in the first embodiment, with the container 11 according to the second embodiment the outer lid 12 can be attached to the container body 14 regardless of how the mesh size of the screen 132 is adjusted with the mesh adjustment mechanism.

Figure 12A:
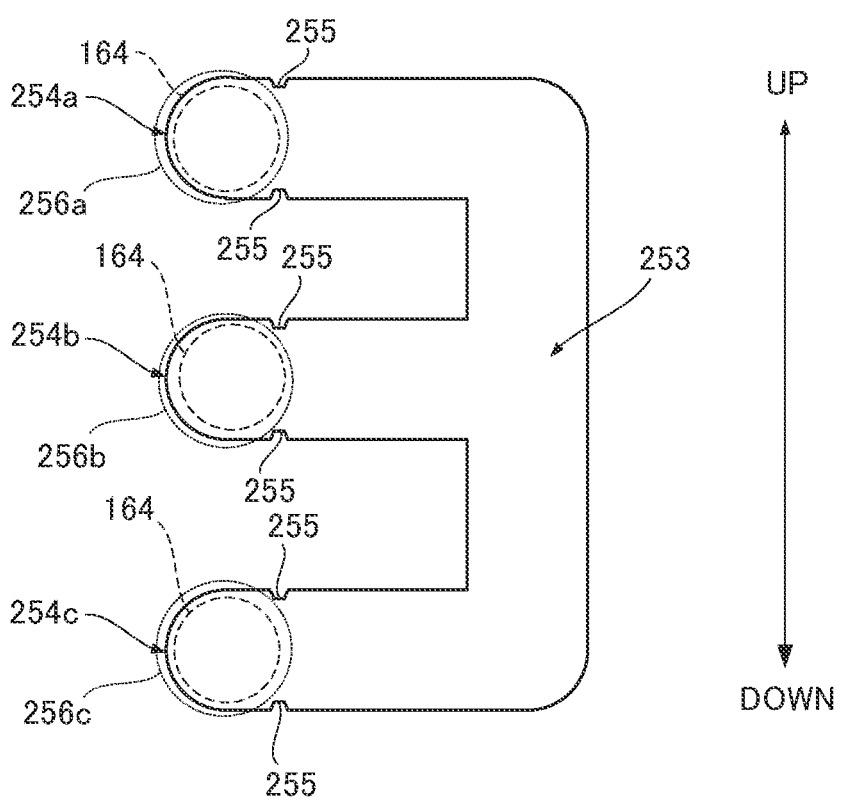
FIGS. 12A and 12B are diagrams illustrating other examples of the shape of the groove.
Figure 12B:
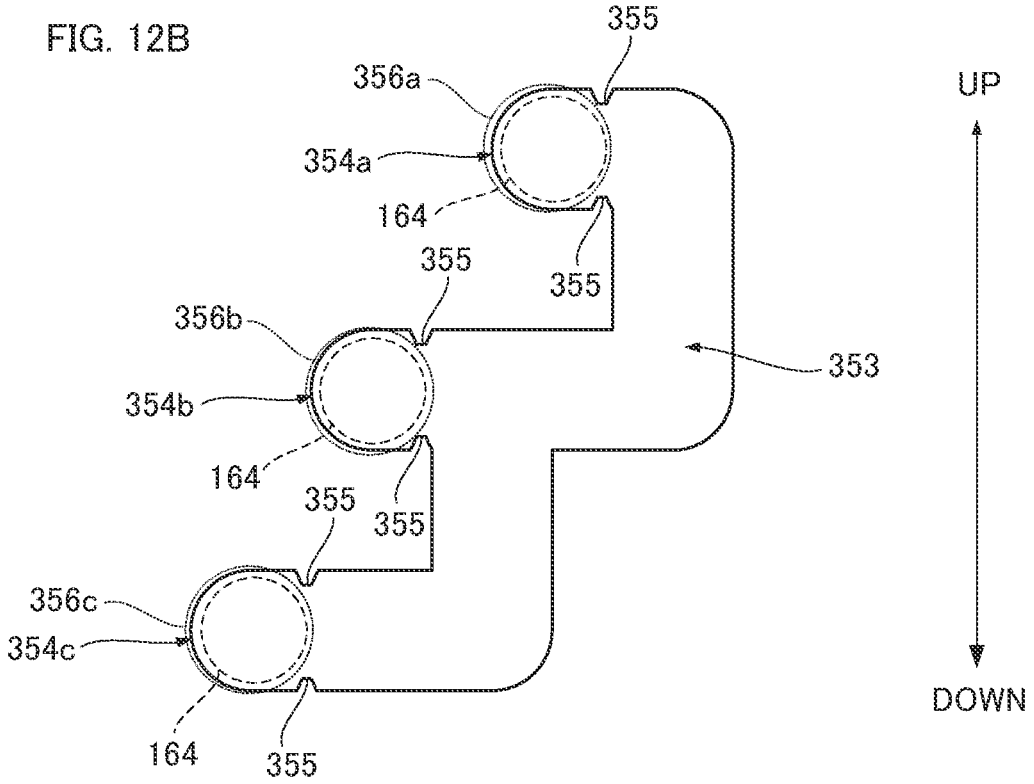

It is to be noted that the shape of the grooves 153 is not limited to the example illustrated in FIG. 10. FIGS. 12A and 12B illustrate modified examples of grooves (253, 353). The groove 253 illustrated in FIG. 12A branches in the inner peripheral direction from each of a plurality of vertical positions extending in the vertical direction to reach respective ends 254*a*, 254*b*, 254*c*. When the protrusion 164 of the screen pressing member 16 surmounts the same protrusions 255 as those formed in the groove 153 illustrated in FIG. 10 adjacent to each of the ends 254*a*, 254*b*, 254*c* at the branching destination, the protrusion 164 is fixed in regions 256, 256*b*, 256*c* indicated by broken line circles in FIGS. 12A, 12B. As a result, the screen pressing member 16 is fixed at one of the three positions in the vertical direction.

The groove 353 illustrated in FIG. 12B has a stepped shape, with each step extending further than the previous one along the inner peripheral surface 152 of the vertical positioning member 15 in the circumferential direction to reach ends 354*a*, 354*b*, 354*c*. Then, adjacent to the ends of each step, protrusions 355 similar to those formed in the grooves 15 illustrated in FIG. 10 are formed in the groove 353. When the projections 164 of the screen pressing member 16 surmount the protrusions 355 in the process of being guided to the ends of the groove 353, the projections 164 are fixed in the regions 356*a*, 356*b*, 356*c* indicated by the broken line circles in FIG. 12B. As a result, the screen pressing member 16 is fixed at one of the three vertical positions corresponding to a respective one of the three ends 354*a*, 354*b*, 354*c* of the groove 353.

As a matter of course, in the groove (153, 253, 353) the regions where the projections 164 of the screen pressing member 16 are fixed is not limited to three places, and by increasing or decreasing the number of ends (154*a*, 154*b*, 154*c*; 254*a*, 254*b*, 254*c*; 354*a*, 354*b*, 354*c*) whose vertical positions are different from each other, it is possible to adjust the vertical position of the screen pressing member 16 either in two steps or in four or more steps. Of course, if the shape of the groove (153, 253, 353) is such that it has ends (154*a*, 154*b*, 154*c*; 254*a*, 254*b*, 254*c*; 354*a*, 354*b*, 354*c*) at different vertical positions, the shape of the groove (153, 253, 353) can be changed as appropriate.

It is sufficient that the projections 164 are held so as to remain fixed at predetermined ends (154*a*, 154*b*, 154*c*; 254*a*, 254*b*, 254*c*; 354*a*, 354*b*, 354*c*) of the groove (153, 253, 353). That is, it is sufficient if the vertical position of the screen pressing member 15 relative to the vertical fixed member material 15 may be maintained according to the holding position of the projections 164 in the groove (153, 253, 353). Alternatively, the projections 164 of the screen pressing member 16 do not have to be fixed at the ends (154*a*, 154*b*, 154*c*; 254*a*, 254*b*, 254*c*; 354*a*, 354*b*, 354*c*) of the groove (153, 253, 353). Thus, for example, while the shape of the groove 255 illustrated in FIG. 12B is a simple stepped shape, it is not necessary to provide the protrusions 255 adjacent to the ends 254*a*, 254*b*, 254*c* shown in FIG. 12A. In any case, it is sufficient that the groove has closed ends in the circumferential direction at different vertical positions so that the projections 164 are held at the vertical position corresponding to each of the ends.

Mesh Size Indicator

In the container 1 according to the first embodiment, the mesh size of the screen 32 can be adjusted steplessly according to how far the screen pressing member (i.e., outer tube) 5 is screwed into the neck 42*b*. However, as the screwing amount is changed, the vertical position of screen pressing member 5 before the change cannot be accurately known and therefore it is difficult to readjust the mesh size of the screen 32 to the mesh size before the change. Accordingly, an indicator designed to enable the user to see the relation between the relative vertical position of the screen pressing member 5 with respect to the screen 32 and the mesh size at that vertical position by a sign such as a line, a mark, a character, a symbol, or a pattern (hereinafter referred to as mesh size indicator) may be provided at an appropriate location on in the container 1.

Figure 13:
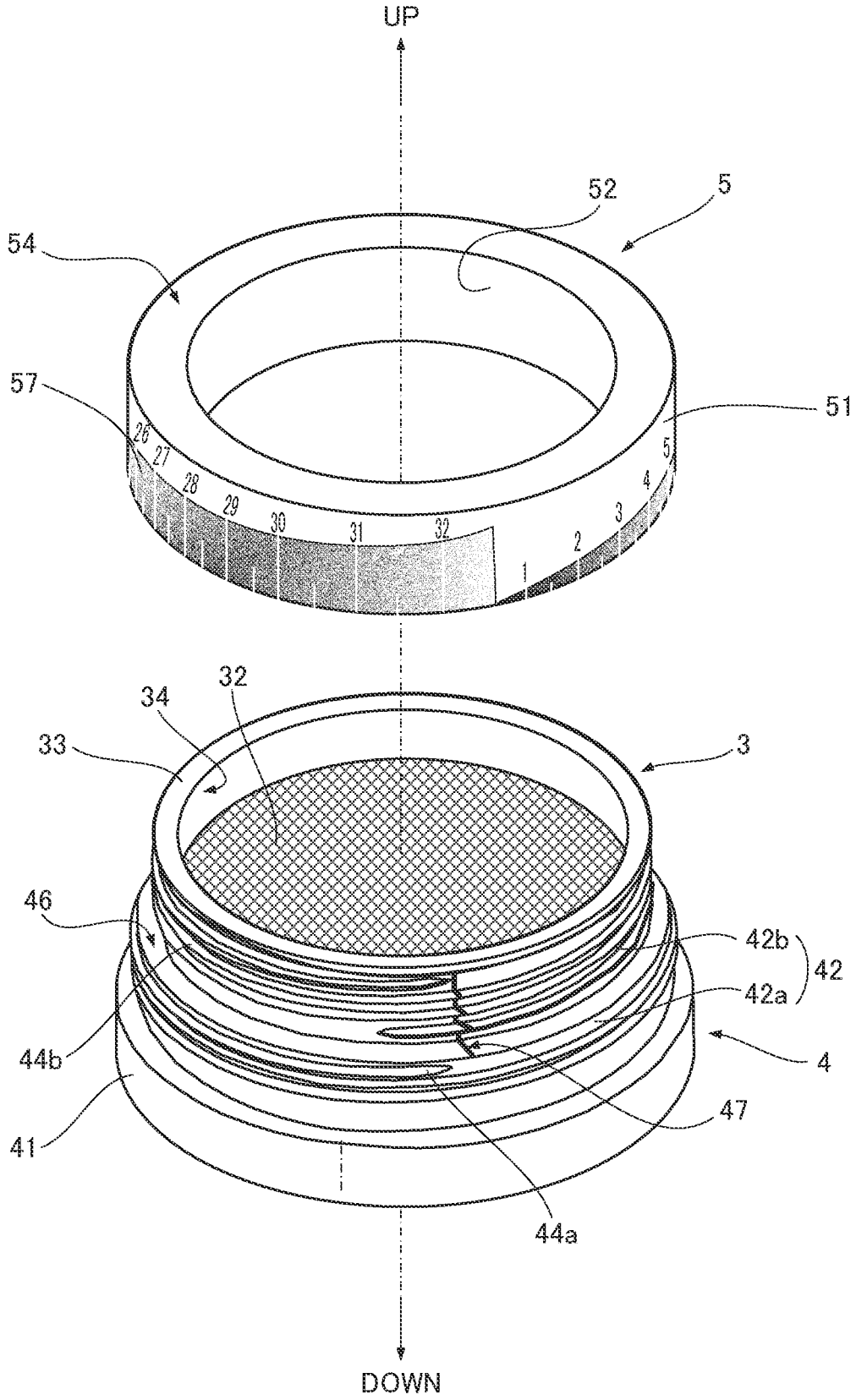
FIG. 13 is a diagram illustrating an example of a mesh size indicator provided in the container with screen according to the first embodiment.

FIG. 13 illustrates an example in which a mesh size indicator is provided on the container 1 according to the first embodiment. In the example illustrated in FIG. 13, the mesh size indicator is provided on both the outer peripheral surface of the screen pressing member 5 and the outer peripheral surface of the upper neck 42*b*. The mesh size indicator on the outer peripheral surface of the screen pressing member 5 is a pattern 57 in which the difference in height between vertical marks gradually narrows in the clockwise direction as viewed from above and a scale is added at equiangular intervals. Further, the pattern 57 is also characterized by a gradation in which the color of the pattern gradually darkens as the difference in height between successive vertical marks narrows. The difference in height between vertical marks and the shading of the pattern 57 are designed to enable the user to quickly see the size of the mesh: The greater the difference in height between vertical marks and the darker the color, the sparser (i.e., larger) the mesh size. Of course, the indicator may also be simply a pattern in which, as the mesh density becomes sparser, the difference in height between vertical marks gradually widens or the color of the pattern gradually fades.

In contrast, the mesh size indicator on the outer peripheral surface of the upper neck 42*b* is a linear shape (hereinafter referred to as indicator line 47) extending downward from the top end of the outer peripheral surface of the upper neck 42*b* of the container body 4 and extending outward in the radial direction at the step 46 in the lower neck 42*a*. The indicator line 47 is for indicating the relative rotation position of the screen pressing member 5.

In the example of the screen density indicator illustrated in FIG. 13, the screen pressing member 5 is such that a female screw thread 53 with a right-hand thread is formed on the inner peripheral surface of the outer tube 51 (see FIGS. 5A, 5B). The female screw thread 53 is designed so as to be in a final state in which the bottom edge of the outer tube 51 as illustrated in FIG. 5B contacts the step 46 between the upper neck 42*b* and the lower neck 42*a* and the screen 32 is stretched when the screen pressing member 5 is tightened one full turn from the initial state illustrated in FIG. 5A in which the bottom edge 56 of the inner tube 52 simply rests on the peripheral edge of the top surface 35 of the screen 32. Further, the indicator line 47 is set to indicate the boundary between the position where the difference in height between vertical marks is the smallest and the position where the difference in height between vertical marks is the greatest in the pattern 57 when the screen pressing member 5 is in either the initial state or the final state.

With such a mesh size indicator as that described above, when the user gradually tightens the screen pressing member 5 attached to the upper neck 42*b* from the initial state, the difference in height between vertical marks along a line of extension of the indicator line 47 in the pattern 57 gradually widens. As a result, the user can quickly see the mesh size of the screen 32 by the difference in height between vertical marks and the degree of shading of the pattern 57 at the indicator line 47 when the screen pressing member 5 is screwed to the desired vertical position. Further, by remembering the relative positions of the indicator line 47 and the scale of the pattern 57, the previous mesh size can be reproduced whenever the mesh size is readjusted thereafter.

In a case in which the screen pressing member 5 is designed to be tightened more than one full turn from the initial state to reach the final state, the screen density indicator composed of the pattern 57 and the indicator line 47 illustrated in FIG. 13 may be replaced with, for example, a screen density indicator with a scale added to the indicator line 47. In such a case, the user can read the scale on the indicator line 47 at the bottom edge position of the outer tube 51 of the screen pressing member 5 to check the relative vertical position of the screen pressing member 5 with respect to the upper neck 42*b*.

Figure 14A:
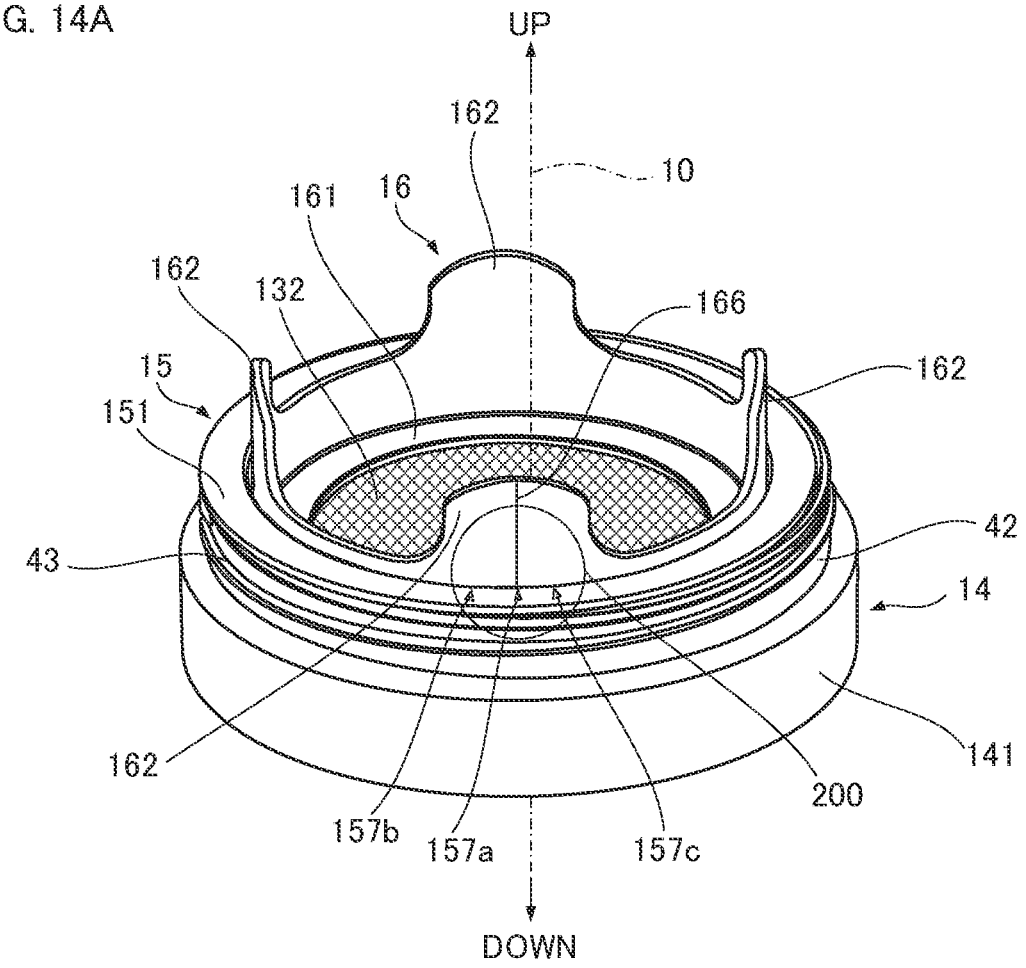
FIGS. 14A and 14B are diagrams illustrating an example of a mesh size indicator provided in the container with screen according to the second embodiment.
Figure 14B:
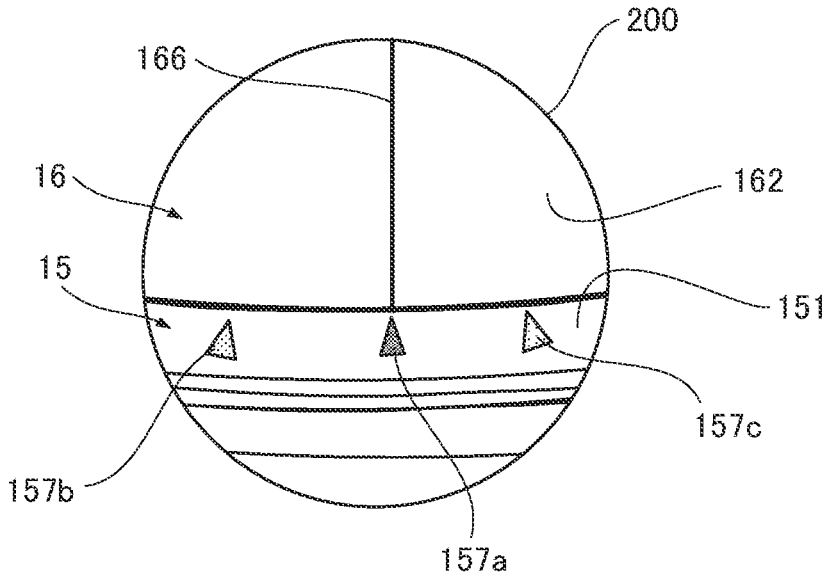

In the container 11 according to the second embodiment, when the difference between the upper and lower positions of the upper and middle stages and the upper and lower positions of the middle and lower positions is small, it may be difficult to ascertain the current mesh density. Therefore, the container 11 according to the second embodiment may also be provided with a mesh size indicator. FIGS. 14A and 14B illustrate an example in which the container 11 according to the second embodiment is provided with a mesh size indicator. FIG. 14A illustrates a state in which the outer lid 12 is removed from the container 11 according to the second embodiment, and FIG. 14B is an enlarged view of the circle 200 in FIG. 14A.

As illustrated in FIG. 14A, an indicator line 166 extending in the vertical direction is provided on one of the rotation assist members 162 formed on the outer peripheral surface 163 of the screen pressing member 16. Three triangular marks 157*a*, 157*b*, 157*c* indicating the rotational position of the screen pressing member 16 when the vertical position of the screen pressing member 16 is fixed are provided on the top surface of the flange 151 of the vertical positioning member 15. As illustrated in FIG. 14B, the triangular marks 157*a*, 157*b*, are in different shades, such that the size of the mesh of the screen 132 is indicated by the darkness of the triangular marks 157*a*, 157*b*, 157*c*. In the case illustrated, the darker the triangular marks 157*a*, 157*b*, 157*c* the smaller the mesh size (the eyes are finer), to enable the user to quickly see the mesh size. Then, when the user fixes the vertical position of the screen pressing member 16 at a desired position while rotating the screen pressing member 16, the user can ascertain the current mesh size by the darkness of the shade of the triangular mark (either 157*a*, 157*b*, or 157*c*) at the position indicated by the indicator line 166. Furthermore, by remembering the shades of the marks 157*a*, 157*b*, 157*c* at the positions indicated by the indicator line 166, the previous mesh size can be reproduced when the mesh size is readjusted thereafter. Note that an indicator line 166 may be provided on two or more of the rotation assist members 162 and sets of the three triangular marks 157*a*, 157*b*, 157*c* may be provided on the top surface of the flange 151 of the vertical positioning member 15 for each such indicator line 166.

Figure 15:
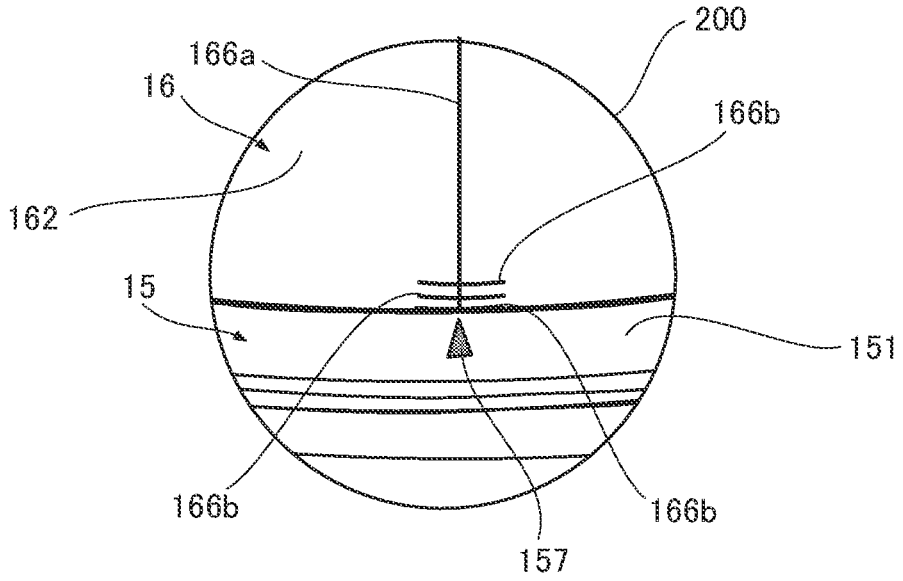
FIG. 15 is a diagram illustrating another example of a mesh size indicator provided in the container with screen according to the second embodiment.

It is to be noted that when a grooves like the grooves 253 as illustrated in FIG. 12A are formed in the vertical positioning member 15, the screen pressing member 16 has the same rotation angle around the axis 10 when fixed at each of the upper and lower position and thus a mesh size indicator like the mesh size indicator illustrated in FIG. 14 cannot be used. In such a case, as illustrated in FIG. 15 the form of the mesh size indicator may be changed. FIG. 15 is an enlarged view corresponding to the region inside the circle 200 in FIG. 14A, illustrating an example of a mesh size indicator used when the container 11 according to the second embodiment includes the vertical positioning member 15 in which the groove 253 illustrated in FIG. 12A is formed. As illustrated in FIG. 15, the indicator line 166*a* in the vertical direction is provided with three scale lines 166*b* corresponding to the vertical positions of the three ends 254*a*, 254*b*, 254*c* of the groove 253. In the vertical positioning member 15, a triangular mark 157 having its apex at a position overlapping the indicator line 166*a* is displayed on the top surface of the flange 151. Accordingly, the user can confirm the relative vertical position of the screen pressing member 16 with respect to the vertical positioning member 15 by the position of the scale on the indicator line 166*a* indicated by the apex of the triangular mark 157.

It is to be noted that the design constituting the mesh size indicator is not limited to printing, and may be formed, for example, by transfer, sticker, asperities in molding die, or the like.

Mesh Size

As described above, the container (1, 11) according to the embodiments is configured to press down on the peripheral edge of the top surface (35, 135) of the screen (32, 132) with the screen pressing member (5, 16) to stretch the screen (32, 132) and thereby increase the mesh size. Of course, screen mesh size is a relative term for expressing the relative fineness of the screen when the screen (32, 132) is not pressed versus when it is pressed, and is not some sort of physical unit or specified measurement method. Therefore, it was investigated whether and to what extent the mesh size actually changed depending on the presence or absence of pressure on the screen (32, 132) and the degree of such pressure.

Specifically, using the container 1 according to the first embodiment, the change between the screwing amount of the screen pressing member 5 with respect to the upper neck 42*b* and the mesh size was investigated using light transmittance. A commercially available light transmittance measuring device (an MJ-TM110 tintometer, manufactured by Sato-Shoji Corporation) was used to measure the amount of light transmittance. With the light transmittance set to 100% when the light was not filtered through the screen 32, the screen 32 was pushed in and the light transmittance was measured (1) in the initial state (when the amount of pressing of the screen 32 by the screen pressing portion 5 was 0 mm), and when (2) the screen pressing member 5 was screwed into the upper neck 42*b* and the screen 32 was pressed 2 mm and 5 mm downward with respect to the screen 32 in the initial state. At the time of measurement, the bottom of the container body 4 was broken open and a light source was inserted into the opening and the light projected upward. A sensor was placed on the top surface side of the screen 32 and the light receiving surface of the sensor was set facing the light source. When the amount of pressure applied to the screen 32 by the screen pressing member 5 depressed the screen 32 by 0 mm, 2 mm, and 5 mm, the light transmittances were 38.7%, 41.9%, and 48.8%, respectively.

The above measurement results are but an example, and the relation between the amount of pressing of the screen 32 by the screen pressing member 5 and the light transmittance differs depending on the mesh size of the screen 32 in the initial state and the elasticity of the material constituting the screen 32. In any case, in the container 1 according to the above-described embodiment, it was confirmed that the mesh size increases as the amount of pressing of the screen 32 by the screen pressing member 5 increases. As a matter of course, the same applies to the container 11 according to the second embodiment.

Other Embodiments

In the container (1, 11) according to the above-described embodiments, the mounting structure of the outer lid (2, 12) with respect to the container body (4, 14) is a screw cap. However, the mounting structure of the outer lid is not limited to a screw cap, and any known mounting structure can be adopted.

In the container 11 according to the second embodiment, the projections 164 are formed on the outer peripheral surface 163 of the screen pressing member 16, and the grooves 153 that engage the projections 164 are formed on the inner peripheral surface 152 of the vertical positioning member 15. Alternatively, the grooves 153 may be provided on the outer surface 163 of the vertical positioning member 15, and the projections 164 may be provided on the inner peripheral surface 152 of the vertical positioning member 15 so as to project inward.

Figure 16:
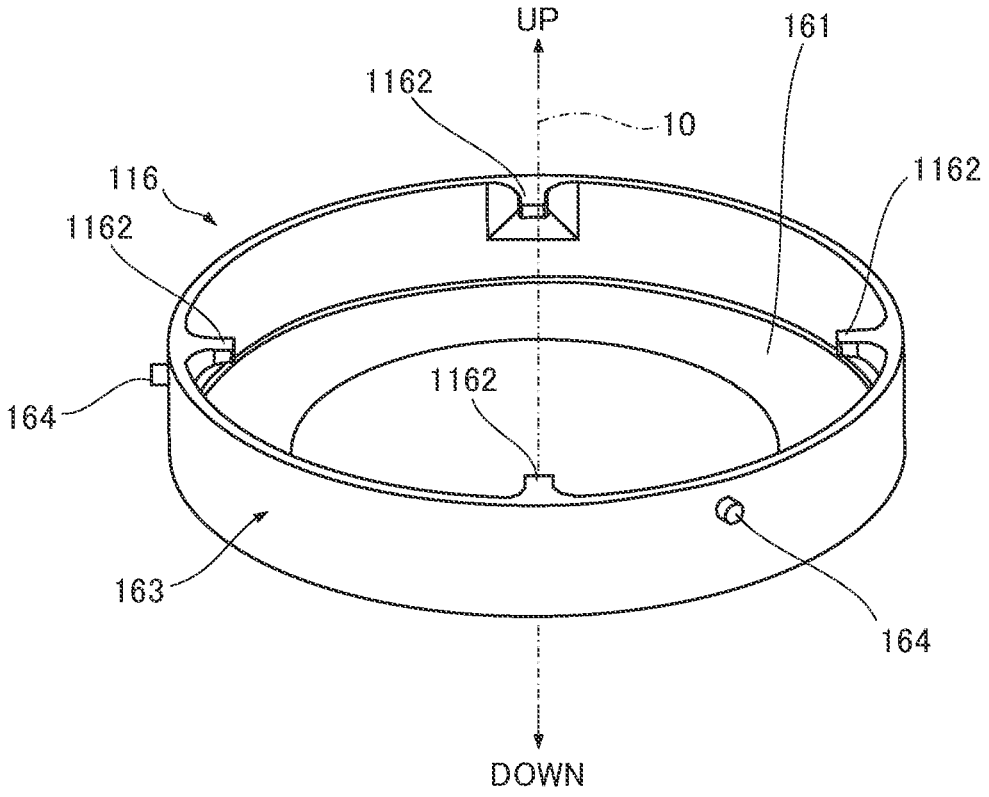
FIG. 16 is a diagram illustrating another example of a screen pressing member provided in the container with screen according to the second embodiment.

In the container 11 according to the second embodiment, a force on the screen pressing member 16 in the rotation direction is easily generated by the user putting fingers on the rotation assist members 162 of the screen pressing member 16. Alternatively, for example, if rotation assist members 1162 are provided on the inner peripheral surface of a screen pressing member 116 so as to project radially inward as illustrated in FIG. 16, the user can rotate the screen pressing member 16 while putting fingers on the rotation assist members 1162.

The contents for the container (1, 11) according to the above-described embodiment are not limited to cosmetics. As the contents, for example, a seasoning composed of powder or granules are conceivable. If the contents for the container (1, 11) according to the above-described embodiment are a seasoning, the amount of the contents extracted when the container body (4, 14) is shaken can be controlled as appropriate by the mesh adjustment mechanism.

Alternatively, the contents may be a viscous fluid such as a cosmetic cream. For example, when the contents are a viscous cosmetic, in the container (1, 11) according to the embodiments the amount of the cosmetic transferred to the puff can be adjusted by the mesh adjustment mechanism.

The container (1, 11) and the members (2, 3, 4, 5, 12, 13, 14, 15, 16) constituting the container (1, 11) according to the above-described embodiments have an external shape that is generally flat and cylindrical. Of course, the external shape of each member (2, 3, 4, 5, 12, 13, 14, 15, 16) constituting the container (1, 11) can be changed as appropriate, and may be, for example, a vertically elongated cylindrical shape.

The neck (42, 142) of the container body (4, 14) may be made into a square cylinder, and the opening (43, 143) of the container body (4, 14), and the frame (31, 131) in the inner lid (3, 13) may have a rectangular shape. For example, in the container 1 according to the first embodiment, when the upper neck 42*b* is a square cylinder and the planar shape of the opening 43 is rectangular, the outer tube 51 and the inner tube 52 of the screen pressing member 5 may both be square cylinders. Then, instead of the male screw thread 44, recesses may be provided at a plurality of positions at the same vertical position on the outer surface of the upper neck 42*b*, and further, sets composed of multiple recesses formed at those same vertical positions may be provided at multiple different vertical positions. Then, hooks that are removable with respect to the recesses of the upper neck 42*b* by utilizing the elasticity of the material (plastic or the like) of the screen pressing member 5 itself may be formed on the inner surface of the outer tube 51 of the screen pressing member 5. As a result, the hooks engage the recesses at different vertical positions and the screen pressing member 5 is fixed at each of the plurality of different vertical positions.

The screen (32, 132) does not necessarily have to be stretched over the frame (31, 131) of the inner lid (3, 13). If the contents do not need to be replaced or replenished, the screen (32, 132) may be disposed so as to cover the opening (43, 143) by being adhered to the top edge of the container body (4, 14). Apart from the opening (43,143) at the top of the neck (42,142), a dedicated opening with a cap for refilling or replacing the contents may also be provided in a suitable place such as the side surface of the container body (4, 14).

In the container (1, 11) according to each of the above embodiments, the vertical position of the screen (32, 132) with respect to the container body (4, 14) is fixed and only the screen pressing portion (5, 16) of the mesh adjustment mechanism is configured to be movable up and down relative to the screen (32, 132). However, if the screen (32, 132) is also configured to be movable up and down with respect to the container body (4, 14), then even if the contents in the container body (4, 14) are reduced and the top surface of the contents moves downward, the gap between the top surface of the contents and the bottom surface of the screen (32, 132) can be kept constant. As a result, if for example the contents are a viscous cosmetic that is transferred to the puff, then the amount of the cosmetic that is transferred to the puff can be kept constant regardless of the amount of the cosmetic remaining in the container body.

In order to enable the screen (32, 132) to move up and down, for example, in the case of container 1 according to the first embodiment, if the upper neck 42*b* is formed as a member separate from the other parts of the container body 4 and only the upper neck 42*b* is configured to be movable up and down with respect to the container body 4, then the entire screen 32 stretched over the inner lid 3 can be moved up and down relative to the container body 4. In order to move the upper neck 42*b* up and down, for example, it is sufficient if a female screw thread is formed on the inner peripheral surface of the lower neck 42*a* and a male screw thread that screws onto this female screw thread is formed on the outer peripheral surface of the bottom edge side of the upper neck 42*b*. In order to enable the screen 132 to move up and down in the container 11 of the second embodiment, for example, conceivably a female screw thread may be formed on the inner peripheral surface of the neck 42 of the container body 4, and a male screw thread screws onto the female screw thread of the neck 42 is formed on the outer peripheral surface of the frame 131 of the inner lid 13 in place of the flange 133.

If the screen is configured to be vertically movable in the manner described above, then if the contents are a viscous cosmetic material it is possible to keep the gap between the top surface of the screen and the cosmetic material constant while arbitrarily setting the amount of pressing against the screen (32, 132) by the mesh pressing mechanism. In addition, in order to keep the gap between the screen (32, 132) and the top surface of the contents constant regardless of the amount of contents in the container body (4, 14), the container body (4, 14) may be provided with a movable bottom that can move up and down.

The outer lid (2, 12), the frame (31, 131), the container body (4, 14), the vertical positioning member 15, and the screen pressing member (5, 16) constituting the container (1, 11) according to the above-described embodiments are all integrally molded products each made of plastic. Alternatively, some or all of the members (2, 3, 4, 12, 13, 14, 15, 16) constituting the container (1, 11) may be made of a material other than plastic, such as metal, wood, glass, or the like. Not all of the members constituting the container (1, 11) have to be integrally molded products and some may instead be composed of a plurality of constituent parts, put together for example by adhering or screwing the parts to each other.

LIST OF REFERENCE NUMBERS

1, 11 container
2, 12 outer lid
3, 13 inner lid
4, 14 container body,
5, 16, 116 screen pressing member (moving member)
10 axis
15 vertical positioning member (fixed member)
31, 131 frame
32, 132 screen
35, 135 top surface of screen
42, 142 neck
42*a* lower neck
42*b* upper neck (fixed member)
43, 143 opening of container body
47, 166, 166*a* indicator line (screen density indicator)
44*a*, 44*b*, 144 male screw thread
51 outer tube
52 inner tube
53 female screw thread,
56 bottom edge of inner tube
57 pattern (screen density indicator)
153, 253, 353 grooves
154*a*-154*c*, 254*a*-254*c*, 354*a*-354*c* ends of grooves
157, 157*a*, 157*b*, 157*c* marks (screen density indicator)
161 bottom
162, 1162 rotation assist members
164 projections
165 bottom surface of screen pressing member

What is claimed is:

1. A container with elastic screen, comprising:

a container body for storing contents, having an opening therein to extract the contents;

an outer lid that seals the opening, detachably attachable to the container body;

a screen made of elastic mesh material, disposed so as to cover the opening of the container body; and a mesh adjustment mechanism for adjusting a mesh size of the screen, having a moving member and a fixed member, wherein, with a normal direction to the plane in which the screen is stretched as the vertical direction, the moving member has a portion that contacts in a ring shape the peripheral edge of the top surface of the screen and makes the portion movable in the vertical direction with respect to the opening, and the fixed member fixes a vertical position of the moving member while being fixed to the opening.

2. The container with elastic screen according to claim 1, further comprising:

a screen pressing member composed of a hollow cylindrical outer tube and a hollow cylindrical inner tube coaxially disposed and connected by an annular top surface provided at a top end of the outer tube and the inner tube, wherein the container body has a top end in which the opening is formed and a hollow cylindrical neck with a male screw thread formed on the outer peripheral surface thereof, the mesh adjustment mechanism is constructed of the neck as the fixed member and the screen pressing member as the moving member, and the outer tube of the screen pressing member has a female screw thread formed on the inner peripheral surface thereof that engages the male screw thread formed on the outer peripheral surface of the neck, wherein, when the outer tube is screwed into the neck, a bottom edge of the inner tube contacts the peripheral edge of the top surface of the screen and presses the peripheral edge downward, and the mesh size of the screen is adjusted according to how far the outer tube is screwed into the neck.

3. The container with elastic screen according to claim 1, wherein the mesh adjustment mechanism further has as the fixed member a vertical positioning member having a flattened hollow cylindrical shape and which is fixed relative to the screen, and as the moving member has the screen pressing member, which is slidably fitted inside the fixed member, wherein the screen pressing member has projections protruding radially outward on an outer peripheral surface thereof, the vertical positioning member has grooves having a predetermined shape on the inner peripheral surface that engage the projections at a plurality of locations, the grooves have closed ends in the circumferential direction at a plurality of locations having different vertical positions, and the mesh size of the screen is adjusted by holding the projections of the screen pressing member at any one of the positions of the ends of the grooves formed at a plurality of locations.

4. The container with elastic screen according to claim 1, wherein the mesh adjustment mechanism further has as the fixed member a vertical positioning member having a flattened hollow cylindrical shape and which is fixed relative to the screen, and as the moving member has the screen pressing member, which is slidably fitted inside the fixed member, the vertical positioning member has grooves having a predetermined shape at a plurality of positions on the outer peripheral surface thereof and projections protruding radially inward from an inner peripheral surface thereof, the screen pressing member has grooves having a predetermined shape that engage the projections at a plurality of locations on the outer peripheral surface thereof, the grooves have closed ends in the circumferential direction at a plurality of locations having different vertical positions, and the mesh size of the screen is adjusted by holding the projections of the vertical positioning member at any one of the positions of the ends of the grooves formed at a plurality of locations.

5. A container with elastic screen according to claim 1, further comprising a mark indicating the mesh size of the screen in relation to the relative vertical position of the moving member with respect to the fixed member.

6. A container with elastic screen according to claim 1, further comprising an inner lid having a frame over which the screen is stretched, wherein the inner lid is attached to the opening of the container body.

* * * * *